US009641952B2

(12) United States Patent
Fejzo et al.

(10) Patent No.: US 9,641,952 B2
(45) Date of Patent: May 2, 2017

(54) ROOM CHARACTERIZATION AND CORRECTION FOR MULTI-CHANNEL AUDIO

(71) Applicant: DTS, Inc., Calabasas, CA (US)

(72) Inventors: Zoran Fejzo, Los Angeles, CA (US); James D. Johnston, Redmond, WA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 14/690,935

(22) Filed: Apr. 20, 2015

(65) Prior Publication Data

US 2015/0230041 A1 Aug. 13, 2015

Related U.S. Application Data

(62) Division of application No. 13/103,809, filed on May 9, 2011, now Pat. No. 9,031,268.

(51) Int. Cl.

| | |
|---|---|
| ***H04R 5/02*** | (2006.01) |
| ***H04S 7/00*** | (2006.01) |
| *H04R 3/00* | (2006.01) |
| *H04S 3/00* | (2006.01) |

(52) U.S. Cl.

CPC ..... *H04S 7/303* (2013.01); *H04R 5/02* (2013.01); *H04S 7/301* (2013.01); *H04R 3/005* (2013.01); *H04S 3/008* (2013.01); *H04S 2400/01* (2013.01); *H04S 2420/01* (2013.01)

(58) Field of Classification Search

CPC ..... H04R 5/02; H04R 3/005; H04S 7/303; H04S 7/301; H04S 3/008; H04S 2400/01; H04S 2420/01

USPC ..... 381/303

See application file for complete search history.

(56) References Cited

U.S. PATENT DOCUMENTS

| | | | | |
|---|---|---|---|---|
| 5,757,927 | A * | 5/1998 | Gerzon | H04S 3/02 381/18 |
| 6,760,451 | B1 * | 7/2004 | Craven | H03G 5/005 381/59 |
| 6,944,510 | B1 | 9/2005 | Ballesty et al. | |
| 7,158,643 | B2 | 1/2007 | Lavoie et al. | |
| 7,630,881 | B2 | 12/2009 | Iser et al. | |
| 7,881,482 | B2 | 2/2011 | Christoph | |
| 8,031,876 | B2 | 10/2011 | Yoshino | |
| 2004/0136538 | A1 | 7/2004 | Cohen et al. | |
| 2005/0053246 | A1 | 3/2005 | Yoshino | |

(Continued)

FOREIGN PATENT DOCUMENTS

| | | |
|---|---|---|
| WO | 92/10876 A1 | 6/1992 |
| WO | 01/82650 | 11/2001 |

(Continued)

OTHER PUBLICATIONS

Office Action in corresponding Chinese Patent Application No. 201280030337.6. mailed Jul. 14, 2015, including cover pages from associates, 11 pages.

(Continued)

*Primary Examiner* — Paul S Kim

(74) *Attorney, Agent, or Firm* — Craig S. Fischer

(57) ABSTRACT

Devices and methods are adapted to characterize a multi-channel loudspeaker configuration, to correct loudspeaker/room delay, gain and frequency response or to configure sub-band domain correction filters.

9 Claims, 17 Drawing Sheets

(56) References Cited

U.S. PATENT DOCUMENTS

| | | | | |
|---|---|---|---|---|
| 2005/0254662 | A1* | 11/2005 | Blank | H04S 7/301 381/58 |
| 2006/0019122 | A1 | 1/2006 | Kawano et al. | |
| 2006/0083389 | A1* | 4/2006 | Oxford | H04R 27/00 381/92 |
| 2006/0140418 | A1 | 6/2006 | Koh et al. | |
| 2006/0167963 | A1 | 7/2006 | Bruno et al. | |
| 2007/0025559 | A1 | 2/2007 | Mihelich et al. | |
| 2007/0121955 | A1* | 5/2007 | Johnston | H04S 7/301 381/56 |
| 2008/0019535 | A1 | 1/2008 | Mitsuhashi et al. | |
| 2009/0274307 | A1 | 11/2009 | Yoshino | |
| 2009/0304192 | A1 | 12/2009 | Zhuang et al. | |

FOREIGN PATENT DOCUMENTS

| | | |
|---|---|---|
| WO | 2006/019122 | 2/2006 |
| WO | 2007076863 | 7/2007 |
| WO | 2010036536 | 4/2010 |

OTHER PUBLICATIONS

Office Action in corresponding Japanese Patent Application No. 2014-510431, mailed Nov. 16, 2015, including cover pages from associates, 8 pages.

Office Action in corresponding Taiwanese Patent Application No. 101116492, mailed Mar. 24, 2016, including cover pages from associates, 7 pages.

International Search Report and Written Opinion in corresponding PCT Application No. PCT/US2012/037081, mailed Oct. 2, 2012, 24 pages.

Tyagi, et al., "On Variable-Scale Piecewise Stationary Spectral Signals for ASR,", Preprint submitted to Elsevier Science. Sep. 11, 2006, [Retrieved on Sep. 19, 2012]. Retrieved from Internet.

David De La Fuente, et al. Time-Varying Process Dynamics Study Based on Adaptive Multivariate AR-Moding; High Technical School of Industrial Engineering, Jan. 6, 2006, Gijon, Spain.

DTS Multi-Channel Audio Playback System: Characterization and Correction AES 130th Convention, May 13-16, 2011, London (UK). Zoran Fejzo and James D. Johnston.

International Preliminary Report on Patentability in corresponding PCT Application No. PCT/US2012/037081, filed May 9, 2012, 24 pages.

Collins: "Implementation of a Non-Linear Room Impulse Response Estimation Algorithm", AES Convention 116/ May 2004, AES, 60 East 42nd St., Room 2520, New York 10165-2520, USA, May 1, 2004, XP040506799.

Extended European Search Report, in related European Application No. 12782597.4-1910, dated May 15, 2015, 19 pages.

Chinese Office Action in corresponding Chinese Patent Application No. 201280030337.6, dated Jun. 8, 2015, 5 pages.

* cited by examiner

ROOM CHARACTERIZATION AND CORRECTION FOR MULTI-CHANNEL AUDIO

CROSS-REFERENCE TO RELATED APPLICATIONS

This application is a divisional application of U.S. patent application Ser. No. 13/103,809 filed on May 9, 2011, entitled "ROOM CHARACTERIZATION AND CORRECTION FOR MULTI-CHANNEL AUDIO", the entire contents which are hereby incorporated herein by reference.

BACKGROUND OF THE INVENTION

Field of the Invention

This invention is directed to a multi-channel audio playback device and method, and more particularly to a device and method adapted to characterize a multi-channel loudspeaker configuration and correct loudspeaker/room delay, gain and frequency response.

Description of the Related Art

Home entertainment systems have moved from simple stereo systems to multi-channel audio systems, such as surround sound systems and more recently 3D sound systems, and to systems with video displays. Although these home entertainment systems have improved, room acoustics still suffer from deficiencies such as sound distortion caused by reflections from surfaces in a room and/or non-uniform placement of loudspeakers in relation to a listener. Because home entertainment systems are widely used in homes, improvement of acoustics in a room is a concern for home entertainment system users to better enjoy their preferred listening environment.

"Surround sound" is a term used in audio engineering to refer to sound reproduction systems that use multiple channels and speakers to provide a listener positioned between the speakers with a simulated placement of sound sources. Sound can be reproduced with a different delay and at different intensities through one or more of the speakers to "surround" the listener with sound sources and thereby create a more interesting or realistic listening experience. A traditional surround sound system includes a two-dimensional configuration of speakers e.g. front, center, back and possibly side. The more recent 3D sound systems include a three-dimensional configuration of speakers. For example, the configuration may include high and low front, center, back or side speakers. As used herein a multi-channel speaker configuration encompasses stereo, surround sound and 3D sound systems.

Multi-channel surround sound is employed in movie theater and home theater applications. In one common configuration, the listener in a home theater is surrounded by five speakers instead of the two speakers used in a traditional home stereo system. Of the five speakers, three are placed in the front of the room, with the remaining two surround speakers located to the rear or sides (THX® dipolar) of the listening/viewing position. A new configuration is to use a "sound bar" that comprises multiple speakers that can simulate the surround sound experience. Among the various surround sound formats in use today, Dolby Surround® is the original surround format, developed in the early 1970's for movie theaters. Dolby Digital® made its debut in 1996. Dolby Digital® is a digital format with six discrete audio channels and overcomes certain limitations of Dolby Surround® that relies on a matrix system that combines four audio channels into two channels to be stored on the recording media. Dolby Digital® is also called a 5.1-channel format and was universally adopted several years ago for film-sound recording. Another format in use today is DTS Digital Surround™ that offers higher audio quality than Dolby Digital® (1,411,200 versus 384,000 bits per second) as well as many different speaker configurations e.g. 5.1, 6.1, 7.1, 11.2 etc. and variations thereof e.g. 7.1 Front Wide, Front Height, Center Overhead, Side Height or Center Height. For example, DTS-HD® supports seven different 7.1 channel configurations on Blu-Ray® discs.

The audio/video preamplifier (or A/V controller or A/V receiver) handles the job of decoding the two-channel Dolby Surround®, Dolby Digital®, or DTS Digital Surround™ or DTS-HD® signal into the respective separate channels. The A/V preamplifier output provides six line level signals for the left, center, right, left surround, right surround, and subwoofer channels, respectively. These separate outputs are fed to a multiple-channel power amplifier or as is the case with an integrated receiver, are internally amplified, to drive the home-theater loudspeaker system.

Manually setting up and fine-tuning the A/V preamplifier for best performance can be demanding. After connecting a home-theater system according to the owners' manuals, the preamplifier or receiver for the loudspeaker setup have to be configured. For example, the A/V preamplifier must know the specific surround sound speaker configuration in use. In many cases the A/V preamplifier only supports a default output configuration, if the user cannot place the 5.1 or 7.1 speakers at those locations he or she is simply out of luck. A few high-end A/V preamplifiers support multiple 7.1 configurations and let the user select from a menu the appropriate configuration for the room. In addition, the loudness of each of the audio channels (the actual number of channels being determined by the specific surround sound format in use) should be individually set to provide an overall balance in the volume from the loudspeakers. This process begins by producing a "test signal" in the form of noise sequentially from each speaker and adjusting the volume of each speaker independently at the listening/viewing position. The recommended tool for this task is the Sound Pressure Level (SPL) meter. This provides compensation for different loudspeaker sensitivities, listening-room acoustics, and loudspeaker placements. Other factors, such as an asymmetric listening space and/or angled viewing area, windows, archways and sloped ceilings, can make calibration much more complicated.

It would therefore be desirable to provide a system and process that automatically calibrates a multi-channel sound system by adjusting the frequency response, amplitude response and time response of each audio channel. It is moreover desirable that the process can be performed during the normal operation of the surround sound system without disturbing the listener.

U.S. Pat. No. 7,158,643 entitled "Auto-Calibrating Surround System" describes one approach that allows automatic and independent calibration and adjustment of the frequency, amplitude and time response of each channel of the surround sound system. The system generates a test signal that is played through the speakers and recorded by the microphone. The system processor correlates the received sound signal with the test signal and determines from the correlated signals a whitened response. U.S. patent publication no. 2007,0121955 entitled "Room Acoustics Correction Device" describes a similar approach.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides devices and methods adapted to characterize a multi-channel loudspeaker configuration, to correct loudspeaker/room delay, gain and frequency response or to configure sub-band domain correction filters.

In an embodiment for characterizing a multi-channel loudspeaker configuration, a broadband probe signal is supplied to each audio output of an A/V preamplifier of which a plurality are coupled to loudspeakers in a multi-channel configuration in a listening environment. The loudspeakers convert the probe signal to acoustic responses that are transmitted in non-overlapping time slots separated by silent periods as sound waves into the listening environment. For each audio output that is probed, sound waves are received by a multi-microphone array that converts the acoustic responses to broadband electric response signals. In the silent period prior to the transmission of the next probe signal, a processor(s) deconvolves the broadband electric response signal with the broadband probe signal to determine a broadband room response at each microphone for the loudspeaker, computes and records in memory a delay at each microphone for the loudspeaker, records the broadband response at each microphone in memory for a specified period offset by the delay for the loudspeaker and determines whether the audio output is coupled to a loudspeaker. The determination of whether the audio output is coupled may be deferred until the room responses for each channel are processed. The processor(s) may partition the broadband electrical response signal as it is received and process the partitioned signal using, for example, a partitioned FFT to form the broadband room response. The processor(s) may compute and continually update a Hilbert Envelope (HE) from the partitioned signal. A pronounced peak in the HE may be used to compute the delay and to determine whether the audio output is coupled to a loudspeaker.

Based on the computed delays, the processor(s) determine a distance and at least a first angle (e.g. azimuth) to the loudspeaker for each connected channel. If the multi-microphone array includes two microphones, the processors can resolve angles to loud speakers positioned in a half-plane either to the front, either side or to the rear. If the multi-microphone array includes three microphones, the processors can resolve angles to loud speakers positioned in the plane defined by the three microphones to the front, sides and to the rear. If the multi-microphone array includes four or more microphones in a 3D arrangement, the processors can resolve both azimuth and elevation angles to loud speakers positioned in three-dimensional space. Using these distances and angles to the coupled loudspeakers, the processor(s) automatically select a particular multi-channel configuration and calculate a position each loudspeaker within the listening environment.

In an embodiment for correcting loudspeaker/room frequency response, a broadband probe signal, and possibly a pre-emphasized probe signal, is or are supplied to each audio output of an A/V preamplifier of which at least a plurality are coupled to loudspeakers in a multi-channel configuration in a listening environment. The loudspeakers convert the probe signal to acoustic responses that are transmitted in non-overlapping time slots separated by silent periods as sound waves into the listening environment. For each audio output that is probed, sound waves are received by a multi-microphone array that converts the acoustic responses to electric response signals. A processor(s) deconvolves the electric response signal with the broadband probe signal to determine a room response at each microphone for the loudspeaker.

The processor(s) compute a room energy measure from the room responses. The processor(s) compute a first part of the room energy measure for frequencies above a cut-off frequency as a function of sound pressure and second part of the room energy measure for frequencies below the cut-off frequency as a function of sound pressure and sound velocity. The sound velocity is obtained from a gradient of the sound pressure across the microphone array. If a dual-probe signal comprising both broadband and pre-emphasized probe signals is utilized, the high frequency portion of the energy measure based only on sound pressure is extracted from the broadband room response and the low frequency portion of the energy measure based on both sound pressure and sound velocity is extracted from the pre-emphasized room response. The dual-probe signal may be used to compute the room energy measure without the sound velocity component, in which case the pre-emphasized probe signal is used for noise shaping. The processor(s) blend the first and second parts of the energy measure to provide the room energy measure over the specified acoustic band.

To obtain a more perceptually appropriate measurement, the room responses or room energy measure may be progressively smoothed to capture substantially the entire time response at the lowest frequencies and essentially only the direct path plus a few milliseconds of the time response at the highest frequencies. The processor(s) computes filter coefficients from the room energy measure, which are used to configure digital correction filters within the processor(s). The processor(s) may compute the filter coefficients for a channel target curve, user defined or a smoothed version of the channel energy measure, and may then adjust the filter coefficients to a common target curve, which may be user defined or an average of the channel target curves. The processor(s) pass audio signals through the corresponding digital correction filters and to the loudspeaker for playback into the listening environment.

In an embodiment for generating sub-band correction filters for a multi-channel audio system, a P-band oversampled analysis filter bank that downsamples an audio signal to base-band for P sub-bands and a P-band oversampled synthesis filter bank that upsamples the P sub-bands to reconstruct the audio signal where P is an integer are provided in a processor(s) in the A/V preamplifier. A spectral measure is provided for each channel. The processor(s) combine each spectral measure with a channel target curve to provide an aggregate spectral measure per channel. For each channel, the processor(s) extract portions of the aggregate spectral measure that correspond to different sub-bands and remap the extracted portions of the spectral measure to base-band to mimic the downsampling of the analysis filter bank. The processor(s) compute an auto-regressive (AR) model to the remapped spectral measure for each sub-band and map coefficients of each AR model to coefficients of a minimum-phase all-zero sub-band correction filter. The processor(s) may compute the AR model by computing an autocorrelation sequence as an inverse FFT of the remapped spectral measure and applying a Levinson-Durbin algorithm to the autocorrelation sequence to compute the AR model. The Levinson-Durbin algorithm produces residual power estimates for the sub-bands that may be used to select the order of the correction filter. The processor(s) configures P digital all-zero sub-band correction filters from the corresponding coefficients that frequency correct the P base band audio signals between the analysis and synthesis filter banks. The processor(s) may compute the filter coefficients for a channel target curve, user defined or a smoothed version of the channel energy measure, and may then adjust the filter coefficients to a common target curve, which may be an average of the channel target curves.

These and other features and advantages of the invention will be apparent to those skilled in the art from the following detailed description of preferred embodiments, taken together with the accompanying drawings, in which:

DETAILED DESCRIPTION OF THE INVENTION

Figure 1A:
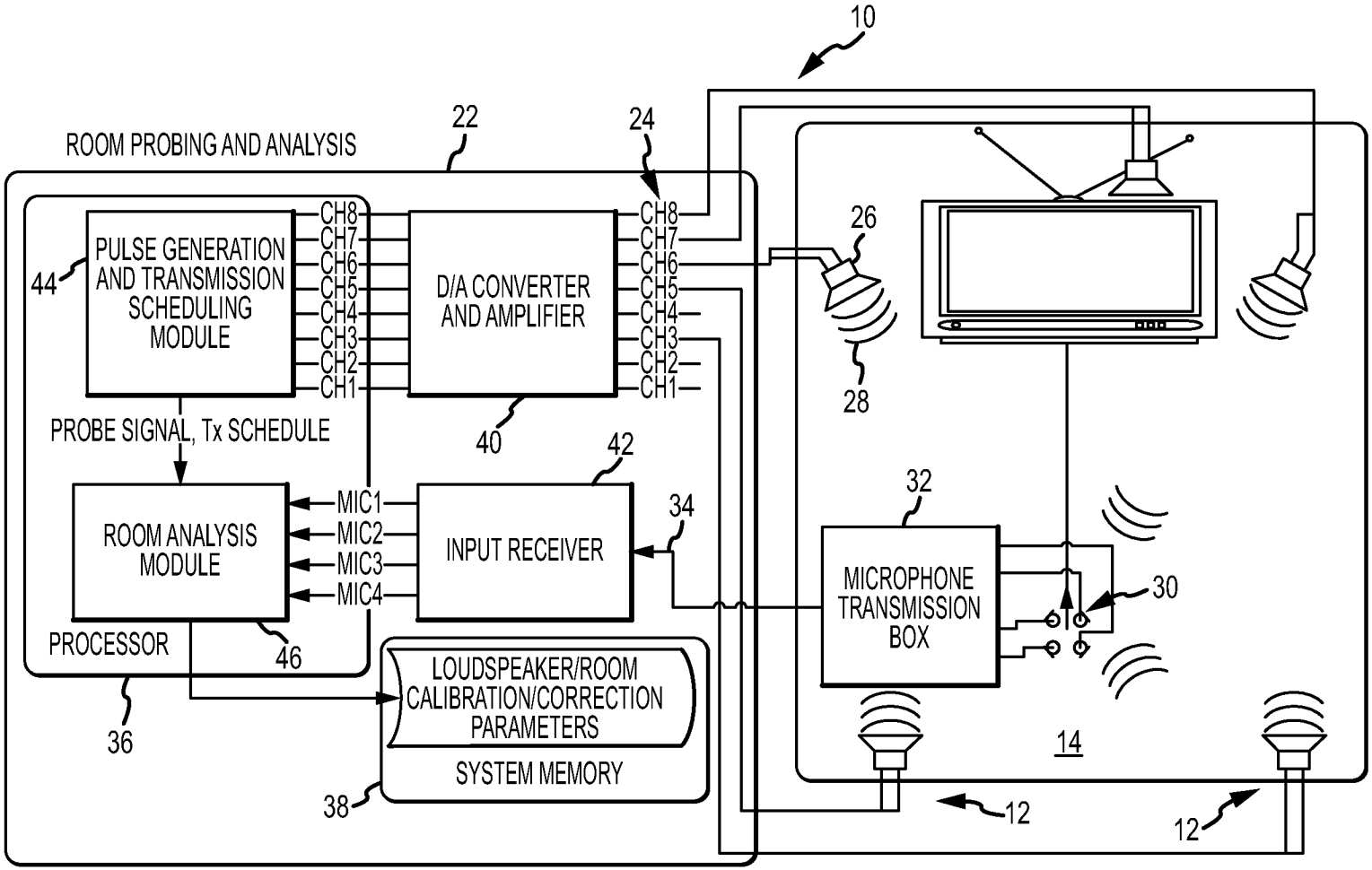
FIGS. 1*a* and 1*b* are a block diagram of an embodiment of a multi-channel audio playback system and listening environment in analysis mode and a diagram of an embodiment of a tetrahedral microphone, respectively.

The present invention provides devices and methods adapted to characterize a multi-channel loudspeaker configuration, to correct loudspeaker/room delay, gain and frequency response or to configure sub-band domain correction filters. Various devices and methods are adapted to automatically locate the loudspeakers in space to determine whether an audio channel is connected, select the particular multi-channel loudspeaker configuration and position each loudspeaker within the listening environment. Various devices and methods are adapted to extract a perceptually appropriate energy measure that captures both sound pressure and velocity at low frequencies and is accurate over a wide listening area. The energy measure is derived from the room responses gathered by using a closely spaced non-coincident multi-microphone array placed in a single location in the listening environment and used to configure digital correction filters. Various devices and methods are adapted to configure sub-band correction filters for correcting the frequency response of an input multi-channel audio signal for deviations from a target response caused by, for example, room response and loudspeaker response. A spectral measure (such as a room spectral/energy measure) is partitioned and remapped to base-band to mimic the downsampling of the analysis filter bank. AR models are independently computed for each sub-band and the models' coefficients are mapped to an all-zero minimum phase filters. Of note, the shapes of the analysis filters are not included in the remapping. The sub-band filter implementation may be configured to balance MIPS, memory requirements and processing delay and can piggyback on the analysis/synthesis filter bank architecture should one already exist for other audio processing.

Multi-Channel Audio Analysis and Playback System

Referring now to the drawings, FIGS. 1*a*-1*b*, 2 and 3 depict an embodiment of a multi-channel audio system 10 for probing and analyzing a multi-channel speaker configuration 12 in a listening environment 14 to automatically select the multi-channel speaker configuration and position the speakers in the room, to extract a perceptually appropriate spectral (e.g. energy) measure over a wide listening area and to configure frequency correction filters and for playback of a multi-channel audio signal 16 with room correction (delay, gain and frequency). Multi-channel audio signal 16 may be provided via a cable or satellite feed or may be read off a storage media such as a DVD or Blu-Ray™ disc. Audio signal 16 may be paired with a video signal that is supplied to a television 18. Alternatively, audio signal 16 may be a music signal with no video signal.

Multi-channel audio system 10 comprises an audio source 20 such as a cable or satellite receiver or DVD or Blu-Ray™ player for providing multi-channel audio signal 16, an A/V preamplifier 22 that decodes the multi-channel audio signal into separate audio channels at audio outputs 24 and a plurality of loudspeakers 26 (electro-acoustic transducers) couple to respective audio outputs 24 that convert the electrical signals supplied by the A/V preamplifier to acoustic responses that are transmitted as sound waves 28 into listening environment 14. Audio outputs 24 may be terminals that are hardwired to loudspeakers or wireless outputs that are wirelessly coupled to the loudspeakers. If an audio output is coupled to a loudspeaker the corresponding audio channel is said to be connected. The loudspeakers may be individual speakers arranged in a discrete 2D or 3D layout or sound bars each comprising multiple speakers configured to emulate a surround sound experience. The system also comprises a microphone assembly that includes one or more microphones 30 and a microphone transmission box 32. The microphone(s) (acousto-electric transducers) receive sound waves associated with probe signals supplied to the loudspeakers and convert the acoustic response to electric signals. Transmission box 32 supplies the electric signals to one or more of the A/V preamplifier's audio inputs 34 through a wired or wireless connection.

A/V preamplifier 22 comprises one or more processors 36 such as general purpose Computer Processing Units (CPUs) or dedicated Digital Signal Processor (DSP) chips that are typically provided with their own processor memory, system memory 38 and a digital-to-analog converter and amplifier 40 connected to audio outputs 24. In some system configurations, the D/A converter and/or amplifier may be separate devices. For example, the A/V preamplifier could output corrected digital signals to a D/A converter that outputs analog signals to a power amplifier. To implement analysis and playback modes of operation, various "modules" of computer program instructions are stored in memory, processor or system, and executed by the one or more processors 36.

A/V preamplifier 22 also comprises an input receiver 42 connected to the one or more audio inputs 34 to receive input microphone signals and provide separate microphone channels to the processor(s) 36. Microphone transmission box 32 and input receiver 42 are a matched pair. For example the transmission box 32 may comprise microphone analog preamplifiers, A/D converters and a TDM (time domain multiplexer) or A/D converters, a packer and a USB transmitter and the matched input receiver 42 may comprise an analog preamplifier and A/D converters, a SPDIF receiver and TDM demultiplexer or a USB receiver and unpacker. The A/V preamplifier may include an audio input 34 for each microphone signal. Alternately, the multiple microphone signals may be multiplexed to a single signal and supplied to a single audio input 34.

To support the analysis mode of operation (presented in FIG. 4), the A/V preamplifier is provided with a probe generation and transmission scheduling module 44 and a room analysis module 46. As detailed in FIGS. 5*a*-5*d*, 6*a*-6*b*, 7 and 8, module 44 generates a broadband probe signal, and possibly a paired pre-emphasized probe signal, and transmits the probe signals via A/D converter and amplifier 40 to each audio output 24 in non-overlapping time slots separated by silent periods according to a schedule. Each audio output 24 is probed whether the output is coupled to a loudspeaker or not. Module 44 provides the probe signal or signals and the transmission schedule to room analysis module 46. As detailed in FIGS. 9 through 14, module 46 processes the microphone and probe signals in accordance with the transmission schedule to automatically select the multi-channel speaker configuration and position the speakers in the room, to extract a perceptually appropriate spectra (energy) measure over a wide listening area and to configure frequency correction filters (such as sub-band frequency correction filters). Module 46 stores the loudspeaker configuration and speaker positions and filter coefficients in system memory 38.

The number and layout of microphones 30 affects the analysis module's ability to select the multi-channel loudspeaker configuration and position the loudspeakers and to extract a perceptually appropriate energy measure that is valid over a wide listening area. To support these functions, the microphone layout must provide a certain amount of diversity to "localize" the loudspeakers in two or three-dimensions and to compute sound velocity. In general, the microphones are non-coincident and have a fixed separation. For example, a single microphone supports estimating only the distance to the loudspeaker. A pair of microphones support estimating the distance to the loudspeaker and an angle such as the azimuth angle in half a plane (front, back or either side) and estimating the sound velocity in a single direction. Three microphones support estimating the distance to the loudspeaker and the azimuth angle in the entire plane (front, back and both side) and estimating the sound velocity a three-dimensional space. Four or more microphones positioned on a three-dimensional ball support estimating the distance to the loudspeaker and the azimuth and elevations angle a full three-dimensional space and estimating the sound velocity a three-dimensional space.

Figure 1B:
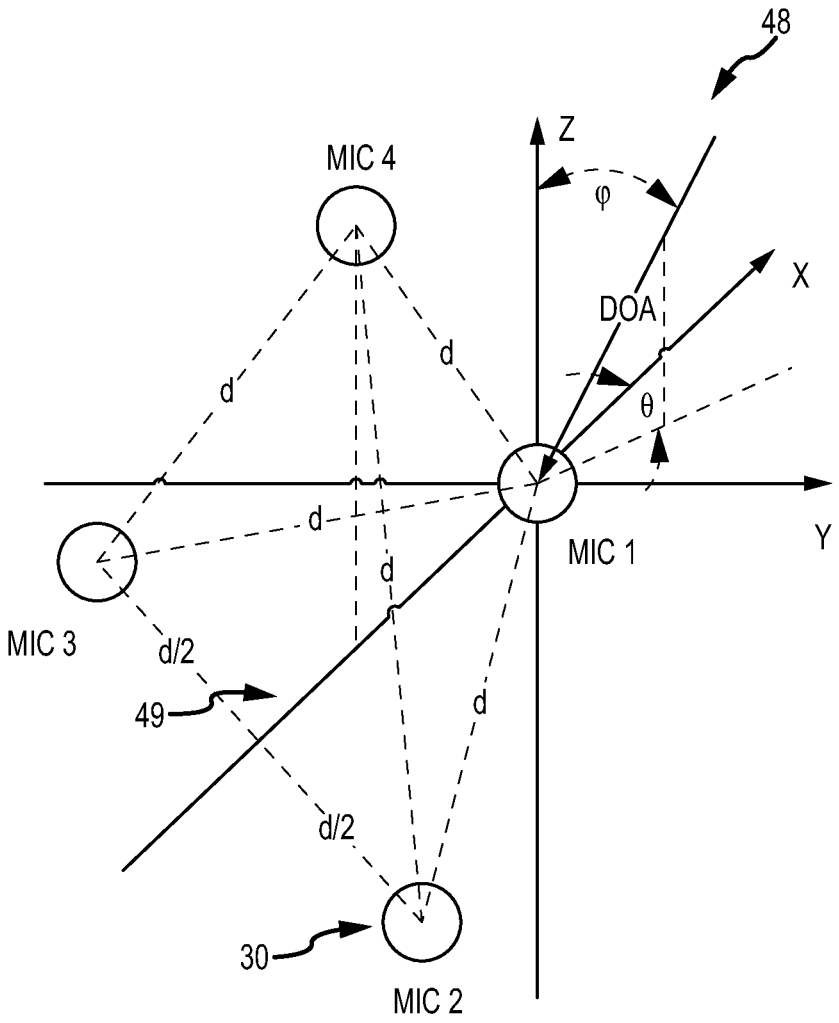
Figure 2:
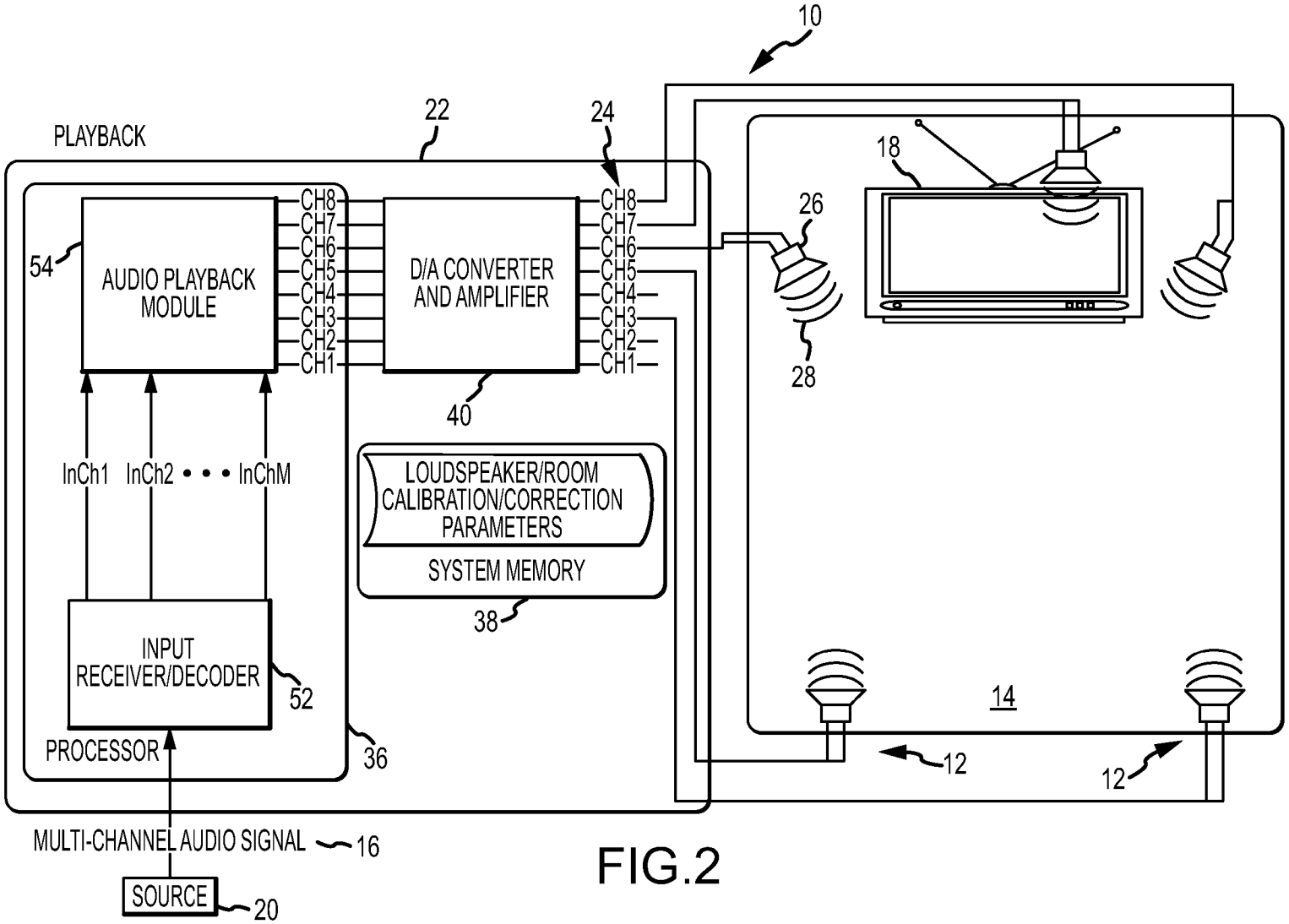
FIG. 2 is a block diagram of an embodiment of a multi-channel audio playback system and listening environment in playback mode.

An embodiment of a multi-microphone array 48 for the case of a tetrahedral microphone array and for a specially selected coordinate system is depicted in FIG. 1*b*. Four microphones 30 are placed at the vertices of a tetrahedral object ("ball") 49. All microphones are assumed to be omnidirectional i.e., the microphone signals represent the pressure measurements at different locations. Microphones 1, 2 and 3 lie in the x,y plane with microphone 1 at the origin of the coordinate system and microphones 2 and 3 equidistant from the x-axis. Microphone 4 lies out of the x,y plane. The distance between each of the microphones is equal and denoted by d. The direction of arrival (DOA) indicates the sound wave direction of arrival (to be used for localization process in Appendix A). The separation of the microphones "d" represents a trade-off of needing a small separation to accurately compute sound velocity up to 500 Hz to 1 kHz and a large separation to accurately position the loudspeakers. A separation of approximately 8.5 to 9 cm satisfies both requirements.

To support the playback mode of operation, the A/V preamplifier is provided with an input receiver/decoder module 52 and an audio playback module 54. Input receiver/decoder module 52 decodes multi-channel audio signal 16 into separate audio channels. For example, the multi-channel audio signal 16 may be delivered in a standard two-channel format. Module 52 handles the job of decoding the two-channel Dolby Surround, Dolby Digital, or DTS Digital Surround™ or DTS-HD® signal into the respective separate audio channels. Module 54 processes each audio channel to perform generalized format conversion and loudspeaker/room calibration and correction. For example, module 54 may perform up or down-mixing, speaker remapping or virtualization, apply delay, gain or polarity compensation, perform bass management and perform room frequency correction. Module 54 may use the frequency correction parameters (e.g. delay and gain adjustments and filter coefficients) generated by the analysis mode and stored in system memory 38 to configure one or more digital frequency correction filters for each audio channel. The frequency correction filters may be implemented in time domain, frequency domain or sub-band domain. Each audio channel is passed through its frequency correction filter and converted to an analog audio signal that drives the loudspeaker to produce an acoustic response that is transmitted as sound waves into the listening environment.

Figure 3:
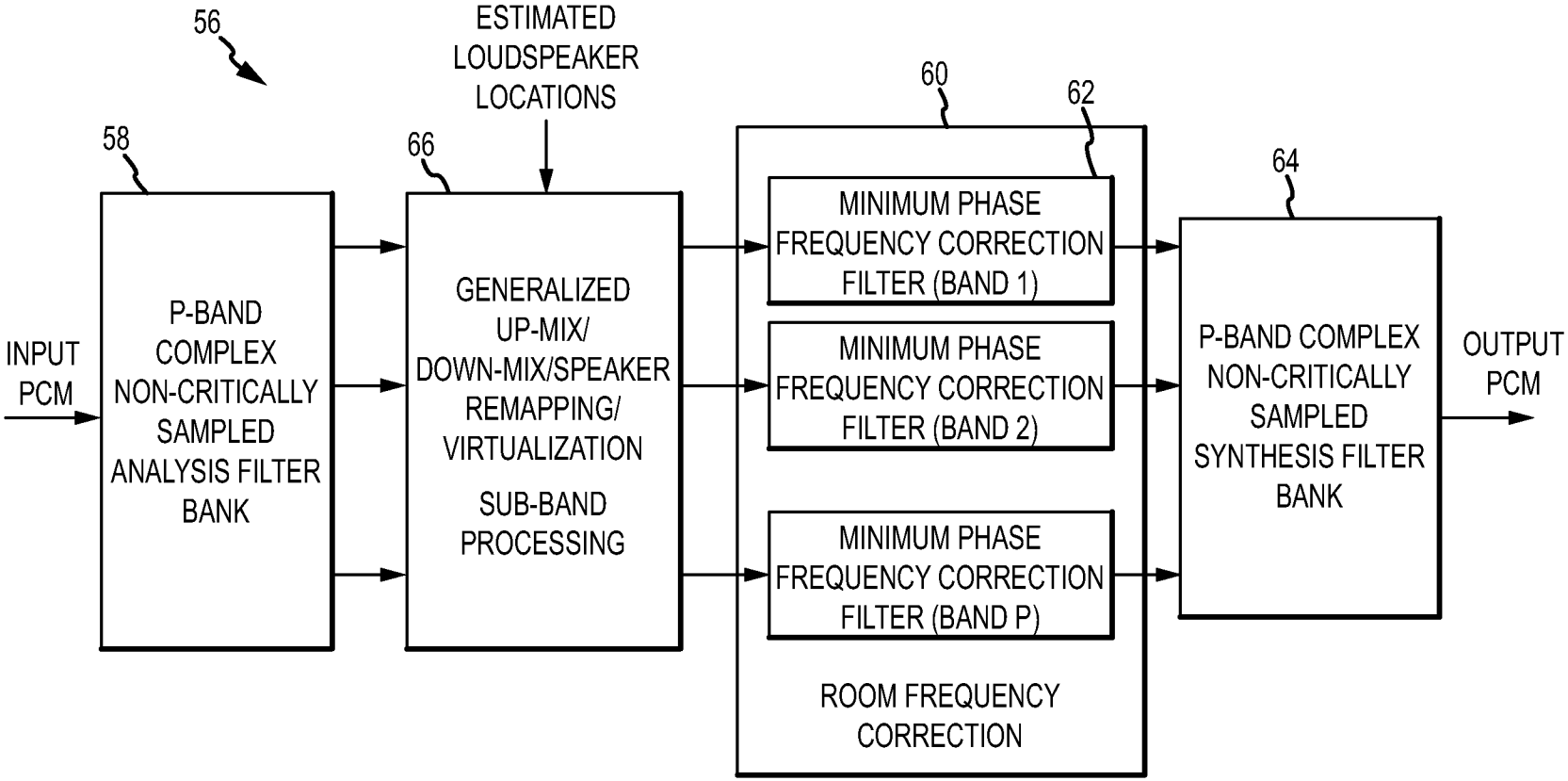
FIG. 3 is a block diagram of an embodiment of sub-band filter bank in playback mode adapted to correct deviations of the loudspeaker/room frequency response determined in analysis mode.

An embodiment of a digital frequency correction filter 56 implemented in the sub-band domain is depicted in FIG. 3. Filter 56 comprises a P-band complex non-critically sampled analysis filter bank 58, a room frequency correction filter 60 comprising P minimum phase FIR (Finite Impulse Response) filters 62 for the P sub-bands and a P-band complex non-critically sampled synthesis filter bank 64 where P is an integer. As shown room frequency correction filter 60 has been added to an existing filter architecture such as DTS NEO-X™ that performs the generalized up/mix/down-mix/speaker remapping/virtualization functions 66 in the sub-band domain. The majority of computations in sub-band based room frequency correction lies in implementation of the analysis and synthesis filter banks. The incremental increase of processing requirements imposed by the addition of room correction to an existing sub-band architecture such as NEO-X™ is minimal.

Frequency correction is performed in sub-band domain by passing an audio signal (e.g. input PCM samples) first through oversampled analysis filter bank 58 then in each band independently applying a minimum-phase FIR correction filter 62, suitably of different lengths, and finally applying synthesis filter bank 64 to create a frequency corrected output PCM audio signal. Because the frequency correction filters are designed to be minimum-phase the sub-band signals even after passing through different length filters are still time aligned between the bands. Consequently the delay introduced by this frequency correction approach is solely determined by the delay in the chain of analysis and synthesis filter banks. In a particular implementation with 64-band over-sampled complex filter-banks this delay is less than 20 milliseconds.

Acquisition, Room Response Processing and Filter Construction

Figure 4:
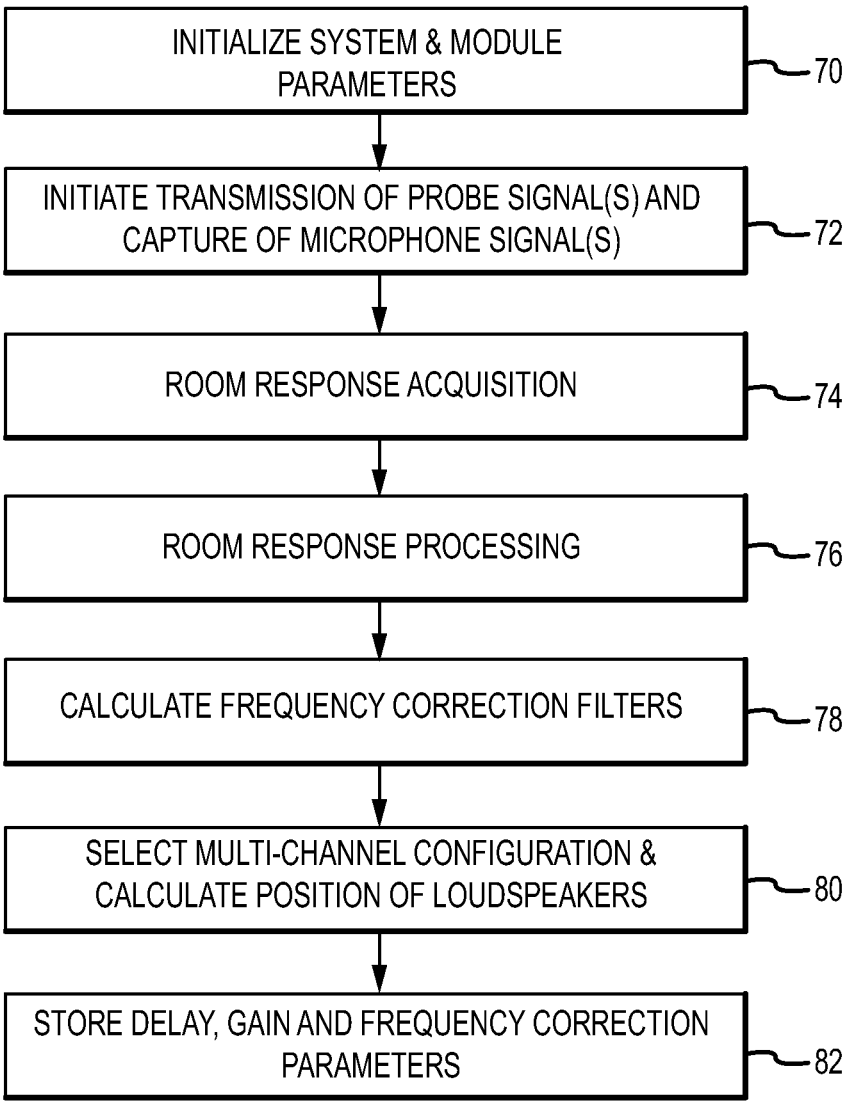
FIG. 4 is a flow diagram of an embodiment of the analysis mode.

A high-level flow diagram for an embodiment of the analysis mode of operation is depicted in FIG. 4. In general, the analysis modules generate the broadband probe signal, and possibly a pre-emphasized probe signal, transmit the probe signals in accordance with a schedule through the loudspeakers as sound waves into the listening environment and record the acoustic responses detected at the microphone array. The modules compute a delay and room response for each loudspeaker at each microphone and each probe signal. This processing may be done in "real time" prior to the transmission of the next probe signal or offline after all the probe signals have been transmitted and the microphone signals recorded. The modules process the room responses to calculate a spectral (e.g. energy) measure for each loudspeaker and, using the spectral measure, calculate frequency correction filters and gain adjustments. Again this processing may be done in the silent period prior to the transmission of the next probe signal or offline. Whether the acquisition and room response processing is done in real-time or offline is a tradeoff off of computations measured in millions of instructions per second (MIPS), memory and overall acquisition time and depends on the resources and requirements of a particular A/V preamplifier. The modules use the computed delays to each loudspeaker to determining a distance and at least an azimuth angle to the loudspeaker for each connected channel, and use that information to automatically select the particular multi-channel configuration and calculate a position for each loudspeaker within the listening environment.

Analysis mode starts by initializing system parameters and analysis module parameters (step 70). System parameters may include the number of available channels (NumCh), the number of microphones (NumMics) and the output volume setting based on microphone sensitivity, output levels etc. Analysis module parameters include the probe signal or signals S (broadband) and PeS (pre-emphasized) and a schedule for transmitting the signal(s) to each of the available channels. The probe signal(s) may be stored in system memory or generated when analysis is initiated. The schedule may be stored in system memory or generated when analysis is initiated. The schedule supplies the one or more probe signals to the audio outputs so that each probe signal is transmitted as sound waves by a speaker into the listening environment in non-overlapping time slots separated by silent periods. The extent of the silent period will depend at least in part on whether any of the processing is being performed prior to transmission of the next probe signal.

The first probe signal S is a broadband sequence characterized by a magnitude spectrum that is substantially constant over a specified acoustic band. Deviations from a constant magnitude spectrum within the acoustic band sacrifice Signal-to-Noise Ratio (SNR), which affects the characterization of the room and correction filters. A system specification may prescribe a maximum dB deviation from constant over the acoustic band. A second probe signal PeS is a pre-emphasized sequence characterized by a pre-emphasis function applied to a base-band sequence that provides an amplified magnitude spectrum over a portion of the specified the acoustic band. The pre-emphasized sequence may be derived from the broadband sequence. In general, the second probe signal may be useful for noise shaping or attenuation in a particular target band that may partially or fully overlap the specified acoustic band. In a particular application, the magnitude of the pre-emphasis function is inversely proportion to frequency within a target band that overlaps a low frequency region of the specified acoustic band. When used in combination with a multi-microphone array the dual-probe signal provides a sound velocity calculation that is more robust in the presence of noise.

The preamplifier's probe generation and transmission scheduling module initiate transmission of the probe signal(s) and capture of the microphone signal(s) P and PeP according to the schedule (step 72). The probe signal(s) (S and PeS) and captured microphone signal(s) (P and PeP) are provided to the room analysis module to perform room response acquisition (step 74). This acquisition outputs a room response, either a time-domain room impulse response (RIR) or a frequency-domain room frequency response (RFR), and a delay at each captured microphone signal for each loudspeaker.

In general, the acquisition process involves a deconvolution of the microphone signal(s) with the probe signal to extract the room response. The broadband microphone signal is deconvolved with the broadband probe signal. The pre-emphasized microphone signal may be deconvolved with the pre-emphasized microphone signal or its base-band sequence, which may be the broadband probe signal. Deconvolving the pre-emphasized microphone signal with its base-band sequence superimposes the pre-emphasis function onto the room response.

The deconvolution may be performed by computing a FFT (Fast Fourier Transform) of the microphone signal, computing a FFT of the probe signal, and dividing the microphone frequency response by the probe frequency response to form the room frequency response (RFR). The RIR is provided by computing an inverse FFT of the RFR. Deconvolution may be performed "off-line" by recording the entire microphone signal and computing a single FFT on the entire microphone signal and probe signal. This may be done in the silent period between probe signals however the duration of the silent period may need to be increased to accommodate the calculation. Alternately, the microphone signals for all channels may be recorded and stored in memory before any processing commences. Deconvolution may be performed in "real-time" by partitioning the microphone signal into blocks as it is captured and computing the FFTs on the microphone and probe signals based on the partition (see FIG. 9). The "real-time" approach tends to reduce memory requirements but increases the acquisition time.

Acquisition also entails computing a delay at each of the captured microphone signals for each loudspeaker. The delay may be computed from the probe signal and microphone signal using many different techniques including cross-correlation of the signals, cross-spectral phase or an analytic envelope such as a Hilbert Envelope (HE). The delay, for example, may correspond to the position of a pronounced peak in the HE (e.g. the maximum peak that exceeds a defined threshold). Techniques such as the HE that produce a time-domain sequence may be interpolated around the peak to compute a new location of the peak on a finer time scale with a fraction of a sampling interval time accuracy. The sampling interval time is the interval at which the received microphone signals are sampled, and should be chosen to be less than or equal to one half of the inverse of the maximum frequency to be sampled, as is known in the art.

Acquisition also entails determining whether the audio output is in fact coupled to a loudspeaker. If the terminal is not coupled, the microphone will still pick up and record any ambient signals but the cross-correlation/cross-spectral phase/analytic envelop will not exhibit a pronounced peak indicative of loudspeaker connection. The acquisition module records the maximum peak and compares it to a threshold. If the peak exceeds the peak, the SpeakerActivityMask [nch] is set to true and the audio channel is deemed connected. This determination can be made during the silent period or off-line.

For each connected audio channel, the analysis module processes the room response (either the RIR or RFR) and the delays from each loudspeaker at each microphone and outputs a room spectral measure for each loudspeaker (step 76). This room response processing may be performed during the silent period prior to transmission of the next probe signal or off-line after all the probing and acquisition is finished. At its simplest, the room spectral measure may comprise the RFR for a single microphone, possibly averaged over multiple microphones and possibly blended to use the broadband RFR at higher frequencies and the pre-emphasized RFR at lower frequencies. Further processing of the room response may yield a more perceptually appropriate spectral response and one that is valid over a wider listening area.

There are several acoustical issues with standard rooms (listening environments) that affect how one may measure, calculate, and apply room correction beyond the usual gain/distance issues. To understand these issues, one should consider the perceptual issues. In particular, the role of "first arrival", also known as "precedence effect" in human hearing plays a role in the actual perception of imaging and timbre. In any listening environment aside from an anechoic chamber, the "direct" timbre, meaning the actual perceived timbre of the sound source, is affected by the first arrival (direct from speaker/instrument) sound and the first few reflections. After this direct timbre is understood, the listener compares that timbre to that of the reflected, later sound in a room. This, among other things, helps with issues like front/back disambiguation, because the comparison of the Head Related Transfer Function (HRTF) influence to the direct vs. the full-space power response of the ear is something humans know, and learn to use. A consideration is that if the direct signal has more high frequencies than a weighted indirect signal, it is generally heard as "frontal", whereas a direct signal that lacks high frequencies will localize behind the listener. This effect is strongest from about 2 kHz upward. Due to the nature of the auditory system, signals from a low frequency cutoff to about 500 Hz are localized via one method, and signals above that by another method.

In addition to the effects of high frequency perception due to first arrival, physical acoustics plays a large part in room compensation. Most loudspeakers do not have an overall flat power radiation curve, even if they do come close to that ideal for the first arrival. This means that a listening environment will be driven by less energy at high frequencies than it will be at lower frequencies. This, alone, would mean that if one were to use a long-term energy average for compensation calculation, one would be applying an undesirable pre-emphasis to the direct signal. Unfortunately, the situation is worsened by the typical room acoustics, because typically, at higher frequencies, walls, furniture, people, etc., will absorb more energy, which reduces the energy storage (i.e. T60) of the room, causing a long-term measurement to have even more of a misleading relationship to direct timbre.

As a result, our approach makes measurements in the scope of the direct sound, as determined by the actual cochlear mechanics, with a long measurement period at lower frequencies (due to the longer impulse response of the cochlear filters), and a shorter measurement period at high frequencies. The transition from lower to higher frequency is smoothly varied. This time interval can be approximated by the rule of t=2/ERB bandwidth where ERB is the equivalent rectangular bandwidth until 't' reaches a lower limit of several milliseconds, at which time other factors in the auditory system suggest that the time should not be further reduced. This "progressive smoothing" may be performed on the room impulse response or on the room spectral measure.

At low frequencies, i.e. long wavelengths, sound energy varies little over different locations as compared to the sound pressure or any axis of velocity alone. Using the measurements from a non-coincident multi-microphone array, the modules compute, at low frequencies, a total energy measure that takes into consideration not just sound pressure but also the sound velocity, preferably in all directions. By doing so, the modules capture the actual stored energy at low frequencies in the room from one point. This conveniently allows the A/V preamplifier to avoid radiating energy into a room at a frequency where there is excess storage, even if the pressure at the measurement point does not reveal that storage, as the pressure zero will be coincident with the maximum of the volume velocity. When used in combination with a multi-microphone array the dual-probe signal provides a room response that is more robust in the presence of noise.

The analysis module uses the room spectral (e.g. energy) measure to calculate frequency correction filters and gain adjustment for each connected audio channel and store the parameters in the system memory (step 78). Many different architectures including time domain filters (e.g. FIR or IIR), frequency domain filters (e.g. FIR implemented by overlap-add, overlap save) and sub-band domain filters can be used to provide the loudspeaker/room frequency correction. Room correction at very low frequencies requires a correction filter with an impulse response that can easily reach a duration of several hundred milliseconds. In terms of required operations per cycle the most efficient way of implementing these filters would be in the frequency domain using overlap-save or overlap-add methods. Due to the large size of the required FFT the inherit delay and memory requirements may be prohibitive for some consumer electronics applications. Delay can be reduced at the price of an increased number of operations per cycle if a partitioned FFT approach is used. However this method still has high memory requirements. When the processing is performed in the sub-band domain it is possible to fine-tune the compromise between the required number of operations per cycle, the memory requirements and the processing delay. Frequency correction in the sub-band domain can efficiently utilize filters of different order in different frequency regions especially if filters in very few sub-bands (as in case of room correction with very few low frequency bands) have much higher order then filters in all other sub-bands. If captured room responses are processed using long measurement periods at lower frequencies and progressively shorter measurement periods towards higher frequencies, the room correction filtering requires even lower order filters as the filtering from low to high frequencies. In this case a sub-band based room frequency correction filtering approach offers similar computational complexity as fast convolution using overlap-save or overlap-add methods; however, a sub-band domain approach achieves this with much lower memory requirements as well as much lower processing delay.

Once all of the audio channels have been processed, the analysis module automatically selects a particular multi-channel configuration for the loudspeakers and computes a position for each loudspeaker within the listening environment (step 80). The module uses the delays from each loudspeaker to each of the microphones to determine a distance and at least an azimuth angle, and preferably an elevation angle to the loudspeaker in a defined 3D coordinate system. The module's ability to resolve azimuth and elevation angles depends on the number of microphones and diversity of received signals. The module readjusts the delays to correspond to a delay from the loudspeaker to the origin of the coordinate system. Based on given system electronics propagation delay, the module computes an absolute delay corresponding to air propagation from loudspeaker to the origin. Based on this delay and a constant speed of sound, the module computes an absolute distance to each loudspeaker.

Using the distance and angles of each loudspeaker the module selects the closest multi-channel loudspeaker configuration. Either due to the physical characteristics of the room or user error or preference, the loudspeaker positions may not correspond exactly with a supported configuration. A table of predefined loudspeaker locations, suitably specified according industry standards, is saved in memory. The standard surround sound speakers lie approximately in the horizontal plane e.g. elevation angle of roughly zero and specify the azimuth angle. Any height loudspeakers may have elevation angles between, for example 30 and 60 degrees. Below is an example of such a table.

| Notation | Location Description (Approximate Angle in Horizontal Plane) |
|---|---|
| CENTER | Center in front of listener (0) |
| LEFT | Left in front (−30) |
| RIGHT | Right in front (30) |
| SRRD_LEFT | Left surround on side in rear (−110) |
| SRRD_RIGHT | Right surround on side in rear (110) |
| LFE_1 | Low frequency effects subwoofer |
| SRRD_CENTER | Center surround in rear (180) |
| REAR_SRRD_LEFT | Left surround in rear (−150) |
| REAR_SRRD_RIGHT | Right surround in rear (150) |
| SIDE_SRRD_LEFT | Left surround on side (−90) |
| SIDE_SRRD_RIGHT | Right surround on side (90) |
| LEFT_CENTER | Between left and center in front (−15) |
| RIGHT_CENTER | Between right and center in front (15) |
| HIGH_LEFT | Left height in front (−30) |
| HIGH_CENTER | Center Height in front (0) |
| HIGH_RIGHT | Right Height in front (30) |
| LFE_2 | 2nd low frequency effects subwoofer |
| LEFT_WIDE | Left on side in front (−60) |
| RIGHT_WIDE | Right on side in front (60) |

-continued

| Notation | Location Description (Approximate Angle in Horizontal Plane) |
|---|---|
| TOP_CENTER_SRRD | Over the listener's head |
| HIGH_SIDE_LEFT | Left height on side (−90) |
| HIGH_SIDE_RIGHT | Right height on side (90) |
| HIGH_REAR_CENTER | Center height in rear (180) |
| HIGH_REAR_LEFT | Left height in rear (−150) |
| HIGH_REAR_RIGHT | Right height in rear (150) |
| LOW_FRONT_CENTER | Center in the plane lower than listener's ears (0) |
| LOW_FRONT_LEFT | Left in the plane lower than listener's ears |
| LOW_FRONT_RIGHT | Right in the plane lower than listener's ears |

Current industry standards specify about nine different layouts from mono to 5.1. DTS-HD® currently specifies four 6.1 configurations:

$C+LR+L_sR_s+C_s$ $C+LR+L_sR_s+O_h$ $LR+L_sR_s+L_hR_h$ $LR+L_sR_s+L_cR_c$ and seven 7.1 configurations $C+LR+LFE_1+L_{sr}R_{sr}+L_{ss}R_{ss}$ $C+LR+L_sR_s+LFE_1+L_{hs}R_{hs}$ $C+LR+L_sR_s+LFE_1+L_hR_h$ $C+LR+L_sR_s+LFE_1+L_{sr}R_{sr}$ $C+LR+L_sR_s+LFE_1+C_s+C_h$ $C+LR+L_sR_s+LFE_1+C_s+O_h$ $C+LR+L_sR_s+LFE_1+L_wR_w$ As the industry moves towards 3D, more industry standard and DTS-HD® layouts will be defined. Given the number of connected channels and the distances and angle(s) for those channels, the module identifies individual speaker locations from the table and selects the closest match to a specified multi-channel configuration. The "closest match" may be determined by an error metric or by logic. The error metric may, for example count the number of correct matches to a particular configuration or compute a distance (e.g. sum of the squared error) to all of the speakers in a particular configuration. Logic could identify one or more candidate configurations with the largest number of speaker matches and then determine based on any mismatches which candidate configuration is the most likely.

The analysis module stores the delay and gain adjustments and filter coefficients for each audio channel in system memory (step 82).

The probe signal(s) may be designed to allow for an efficient and accurate measurement of the room response and a calculation of an energy measure valid over a wide listening area. The first probe signal is a broadband sequence characterized by a magnitude spectrum that is substantially constant over a specified acoustic band. Deviations from "constant" over the specified acoustic band produce a loss of SNR at those frequencies. A design specification will typically specify a maximum deviation in the magnitude spectrum over the specified acoustic band.

Probe Signals and Acquisition

Figure 5A:
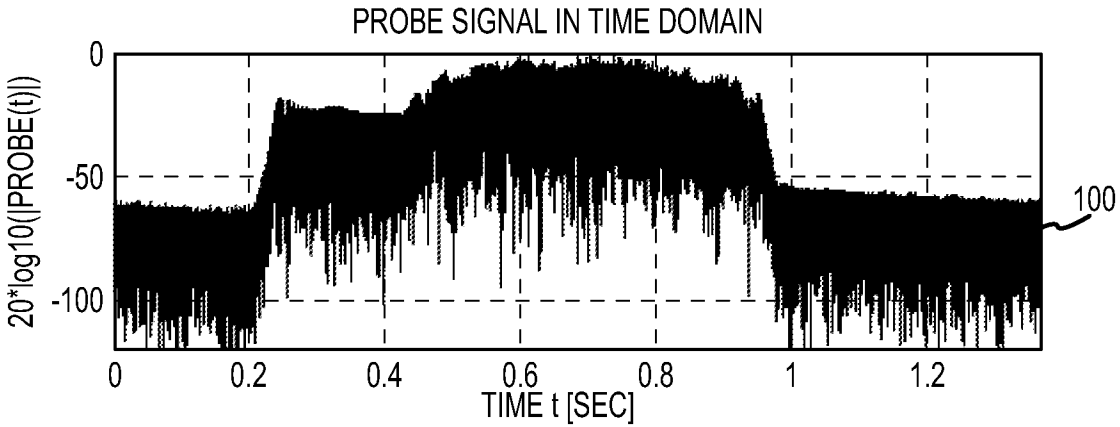
FIGS. 5*a* through 5*d* are time, frequency and autocorrelation sequences for an all-pass probe signal.
Figure 5B:
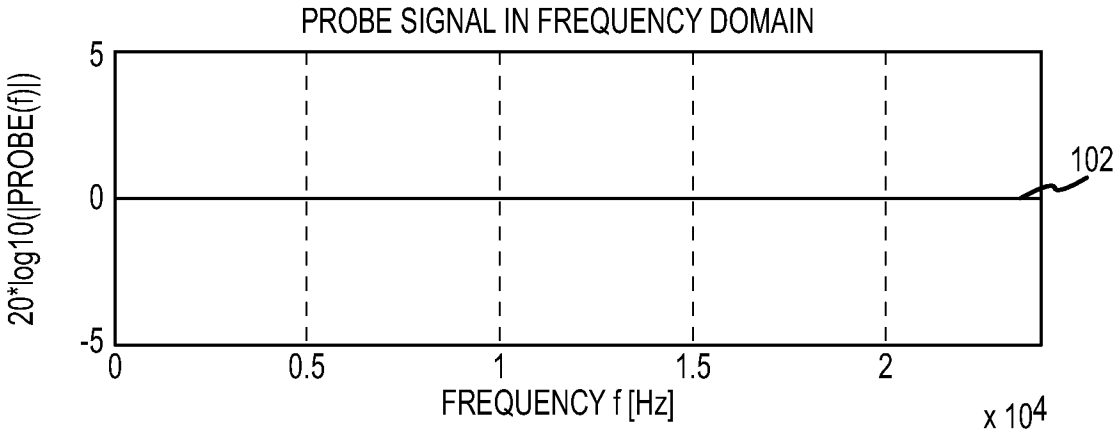
Figure 5C:
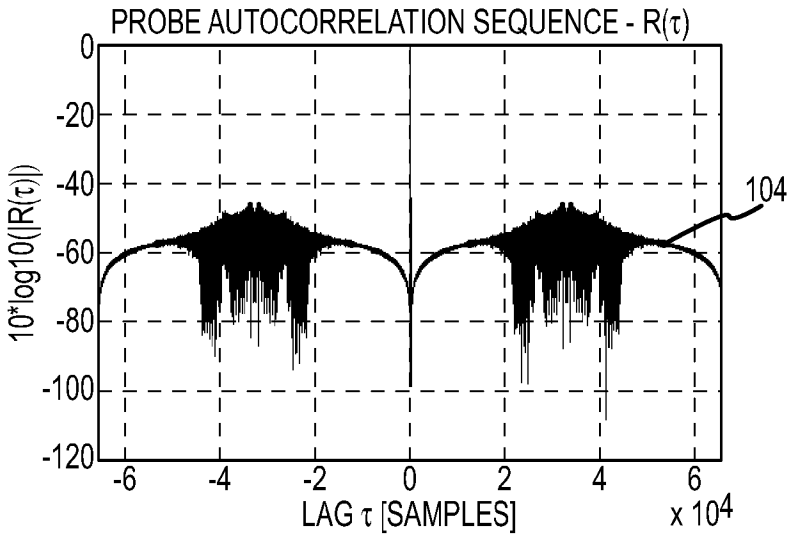
Figure 5D:
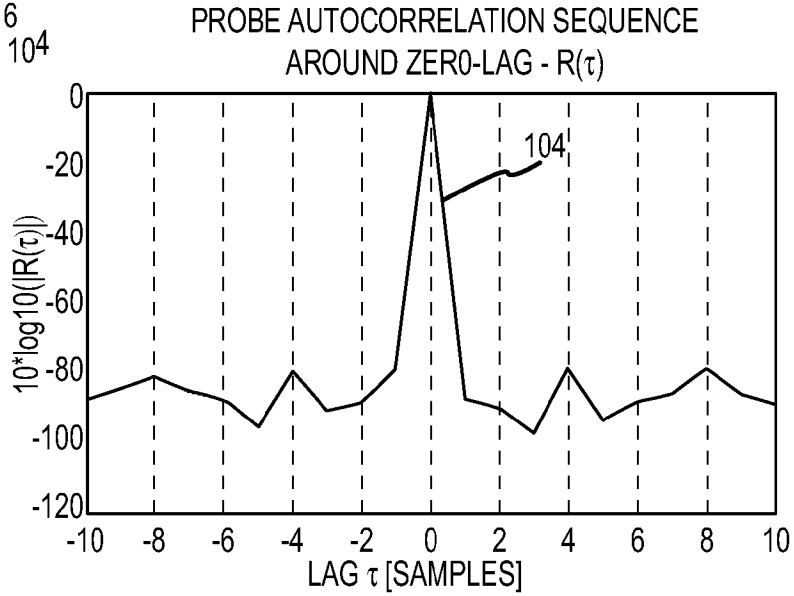

One version of the first probe signal S is an all-pass sequence 100 as shown in FIG. 5*a*. As shown in FIG. 5*b*, the magnitude spectrum 102 of an all-pass sequence APP is approximately constant (i.e. 0 dB) over all frequencies. This probe signal has a very narrow peak autocorrelation sequence 104 as shown in FIGS. 5*c* and 5*d*. The narrowness of the peak is inversely proportional to the bandwidth over which the magnitude spectrum is constant. The autocorrelation sequence's zero-lag value is far above any non-zero lag values and does not repeat. How much depends on the length of the sequence. A sequence of 1,024 ($2^{10}$) samples will have a zero-lag value at least 30 dB above any non-zero lag values while a sequence of 65,536 ($2^{16}$) samples will have a zero-lag value at least 60 dB above any non-zero lag values. The lower the non-zero lag values the greater the noise rejection and the more accurate the delay. The all-pass sequence is such that during the room response acquisition process the energy in the room will be building up for all frequencies at the same time. This allows for shorter probe length when compared to sweeping sinusoidal probes. In addition, all-pass excitation exercises loudspeakers closer to their nominal mode of operation. At the same time this probe allows for accurate full bandwidth measurement of loudspeaker/room responses allowing for a very quick overall measurement process. A probe length of $2^{16}$ samples allows for a frequency resolution of 0.73 Hz.

The second probe signal may be designed for noise shaping or attenuation in a particular target band that may partially or fully overlap the specified acoustic band of the first probe signal. The second probe signal is a pre-emphasized sequence characterized by a pre-emphasis function applied to a base-band sequence that provides an amplified magnitude spectrum over a portion of the specified the acoustic band. Because the sequence has an amplified magnitude spectrum (>0 dB) over a portion of the acoustic band it will exhibit an attenuated magnitude spectrum (<0 dB) over other portions of the acoustic band for energy conservation, hence is not suitable for use as the first or primary probe signal.

Figure 6A:
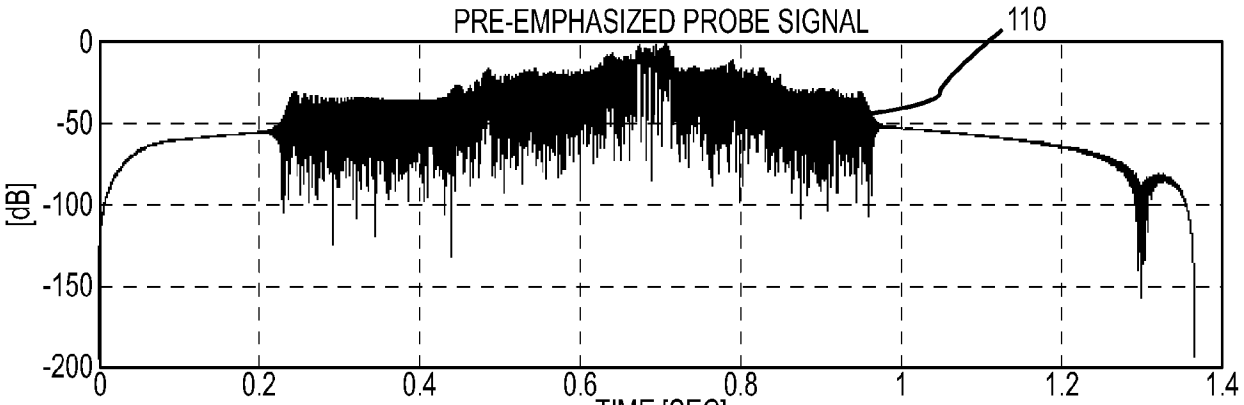
FIGS. 6*a* and 6*b* are a time sequence and magnitude spectrum of a pre-emphasized probe signal.
Figure 6B:
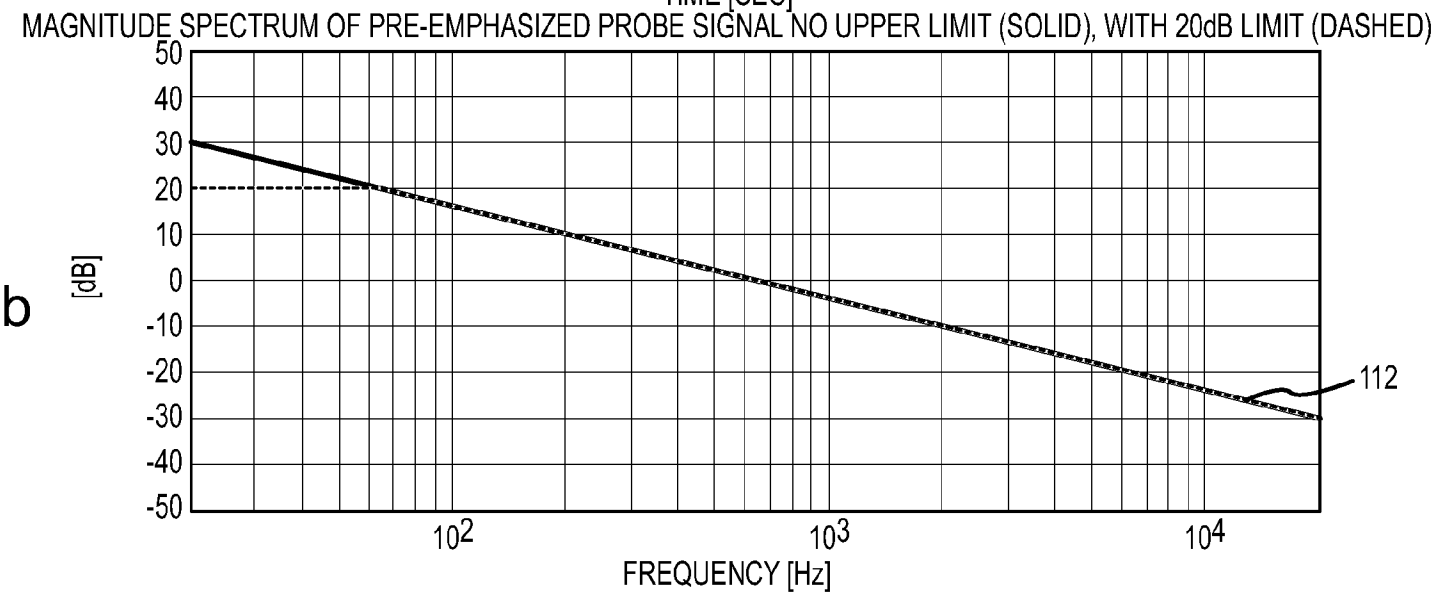

One version of the second probe signal PeS as shown in FIG. 6*a* is a pre-emphasized sequence 110 in which the pre-emphasis function applied to the base-band sequence is inversely proportion to frequency ($c/\omega d$) where c is the speed of sound and d is the separation of the microphones over a low frequency region of the specified acoustic band. Note, radial frequency $\omega=2\pi f$ where f is Hz. As the two are represented by a constant scale factor, they are used interchangeably. Furthermore, the functional dependency on frequency may be omitted for simplicity. As shown in FIG. 6*b*, the magnitude spectrum 112 is inversely proportion to frequency. For frequencies less than 500 Hz, the magnitude spectrum is >0 dB. The amplification is clipped at 20 dB at the lowest frequencies. The use of the second probe signal to compute the room spectral measure at low frequencies has the advantage of attenuating low frequency noise in the case of a single microphone and of attenuating low frequency noise in the pressure component and improving the computation of the velocity component in the case of a multi-microphone array.

Figure 7:
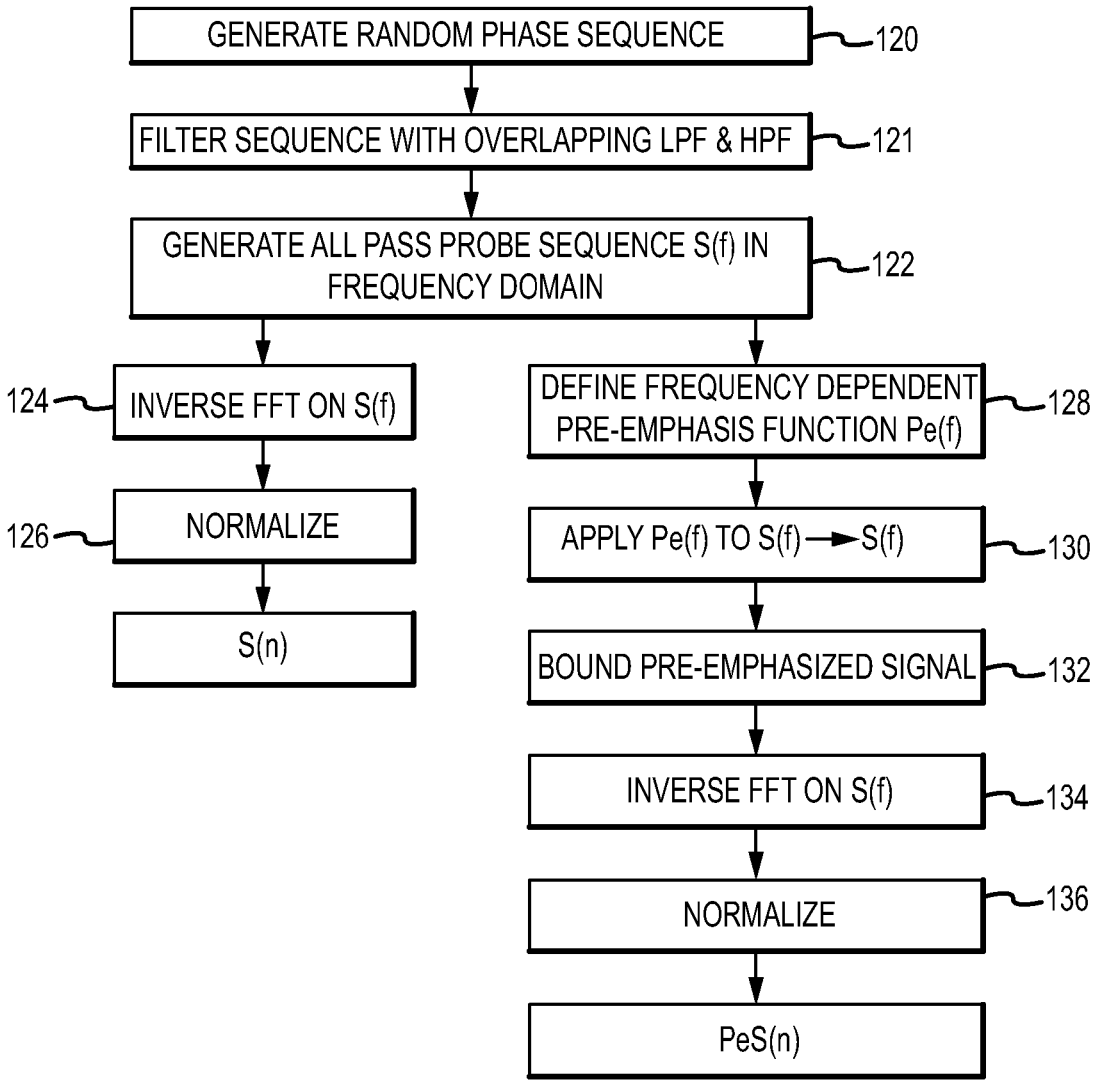
FIG. 7 is a flow diagram of an embodiment for generating an all-pass probe signal and a pre-emphasized probe signals from the same frequency domain signal.

There are many different ways to construct the first broadband probe signal and the second pre-emphasized probe signal. The second pre-emphasized probe signal is generated from a base-band sequence, which may or may not be the broadband sequence of the first probe signal. An embodiment of a method for constructing an all-pass probe signal and a pre-emphasized probe signal is illustrated in FIG. 7.

In accordance with one embodiment of the invention, the probe signals are preferably constructed in the frequency domain by generating a random number sequence between $-\pi$, $+\pi$ having a length of a power of $2^n$ (step 120). There are many known techniques to generate a random number sequence, the MATLAB (Matrix Laboratory) "rand" function based on the Mersene Twister algorithm may suitably be used in the invention to generate a uniformly distributed pseudo-random sequence. Smoothing filters (e.g. a combination of overlapping high-pass and low-pass filters) are applied to the random number sequence (step 121). The random sequence is used as the phase ($\phi$) of a frequency response assuming an all-pass magnitude to generate the all-pass probe sequence S(f) in the frequency domain (step 122). The all pass magnitude is $S(f)=1*e^{(j2\pi\phi(f))}$ where S(f) is conjugate symmetric (i.e. the negative frequency part is set to be the complex conjugate of the positive part). The inverse FFT of S(f) is calculated (step 124) and normalized (step 126) to produce the first all-pass probe signal S(n) in the time domain where n is a sample index in time. The frequency dependent (Mod) pre-emphasis function Pe(f) is defined (step 128) and applied to the all-pass frequency domain signal S(f) to yield PeS(f) (step 130). PeP(f) may be bound or clipped at the lowest frequencies (step 132). The inverse FFT of PeS(f) is calculated (step 134), examined to ensure that there are no serious edge-effects and normalized to have high level while avoiding clipping (step 136) to produce the second pre-emphasized probe signal PeS(n) in the time domain. The probe signal(s) may be calculated offline and stored in memory.

Figure 8:
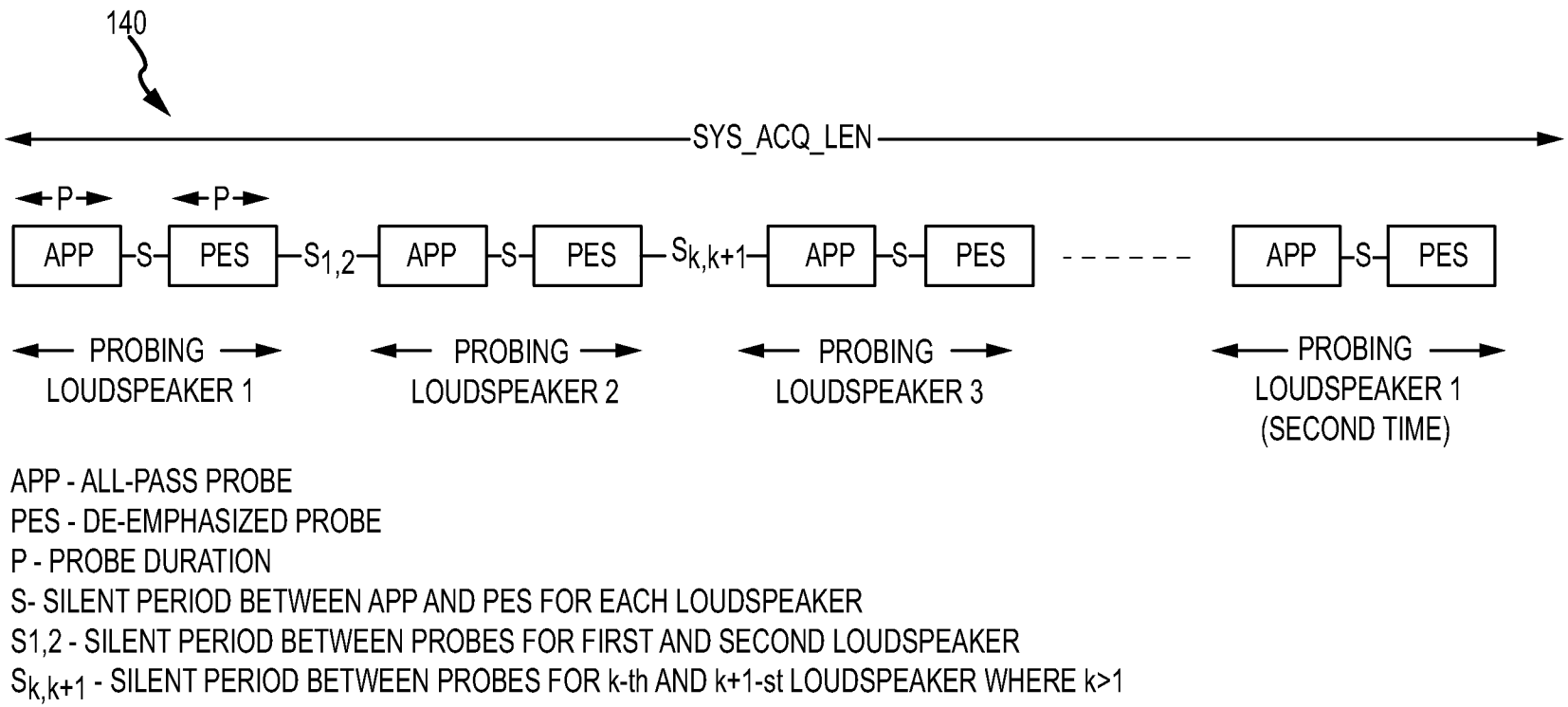
FIG. 8 is a diagram of an embodiment for scheduling the transmission of the probe signals for acquisition.

As shown in FIG. 8, in an embodiment the A/V preamplifier supplies the one or more probe signals, all-pass probe (APP) and pre-emphasized probe (PES) of duration (length) "P", to the audio outputs in accordance with a transmission schedule 140 so that each probe signal is transmitted as sound waves by a loudspeaker into the listening environment in non-overlapping time slots separated by silent periods. The preamplifier sends one probe signal to one loudspeaker at a time. In the case of dual probing, the all-pass probe APP is sent first to a single loudspeaker and after a predetermined silent period the pre-emphasized probe signal PES is sent to the same loudspeaker.

A silent period "S" is inserted between the transmission of the $1^{st}$ and $2^{nd}$ probe signals to the same speaker. A silent period $S_{1,2}$ and $S_{k,k+1}$ is inserted between the transmission of the $1^{St}$ and $2^{nd}$ probe signals between the $1^{st}$ and $2^{nd}$ loud speakers and the $k^{th}$ and $k^{th}+1$ loudspeakers, respectively, to enable robust yet fast acquisition. The minimum duration of the silent period S is the maximum RIR length to be acquired. The minimum duration of the silent period $S_{1,2}$ is the sum of the maximum RIR length and the maximum assumed delay through the system. The minimum duration of the silent period $S_{k,k+1}$ is imposed by the sum of (a) the maximum RIR length to be acquired, (b) twice the maximum assumed relative delay between the loudspeakers and (c) twice the room response processing block length. Silence between the probes to different loudspeakers may be increased if a processor is performing the acquisition processing or room response processing in the silent periods and requires more time to finish the calculations. The first channel is suitably probed twice, once at the beginning and once after all other loudspeakers to check for consistency in the delays. The total system acquisition length $Sys_Acq_Len=2*P+S+S_{1,2}+N_LoudSpkrs*(2*P+S+S_{k,k+1})$. With a probe length of 65,536 and dual-probe test of 6 loudspeakers the total acquisition time can be less than 31 seconds.

The methodology for deconvolution of captured microphone signals based on very long FFTs, as described previously, is suitable for off-line processing scenarios. In this case it is assumed that the pre-amplifier has enough memory to store entire captured microphone signal and only after the capturing process is completed to start the estimation of the propagation delay and room response.

In DSP implementations of room response acquisition, to minimize the required memory and required duration of the acquisition process, the A/V preamplifier suitably performs the de-convolution and delay estimation in real-time while capturing the microphone signals. The methodology for real-time estimation of delays and room responses can be tailored for different system requirements in terms of trade-off between memory, MIPS and acquisition time requirements:

- The deconvolution of captured microphone signals is performed via a matched filter whose impulse response is a time-reversed probe sequence (i.e., for a 65536-sample probe we have a 65536-tap FIR filter). For reduction of complexity the matched filtering is done in the frequency domain and for reduction in memory requirements and processing delay the partitioned FFT overlap and save method is used with 50% overlap.
- In each block this approach yields a candidate frequency response that corresponds to a specific time portion of a candidate room impulse response. For each block an inverse FFT is performed to obtain new block of samples of a candidate room impulse response (RIR).
- Also from the same candidate frequency response, by zeroing its values for negative frequencies, applying IFFT to the result, and taking the absolute value of the IFFT, a new block of samples of an analytic envelope (AE) of the candidate room impulse response is obtained. In an embodiment the AE is the Hilbert Envelope (HE)
- The global peak (over all blocks) of the AE is tracked and its location is recorded.
- The RIR and AE are recorded starting a predetermined number of samples prior to the AE global peak location; this allows for fine-tuning of the propagation delay during room response processing.
- In every new block if the new global peak of the AE is found the previously recorded candidate RIR and AE are reset and recording of new candidate RIR and AE are started.
- To reduce false detection the AE global peak search space is limited to expected regions; these expected regions for each loudspeaker depend on assumed maximum delay through the system and the maximum assumed relative delays between the loudspeakers.

Figure 9:
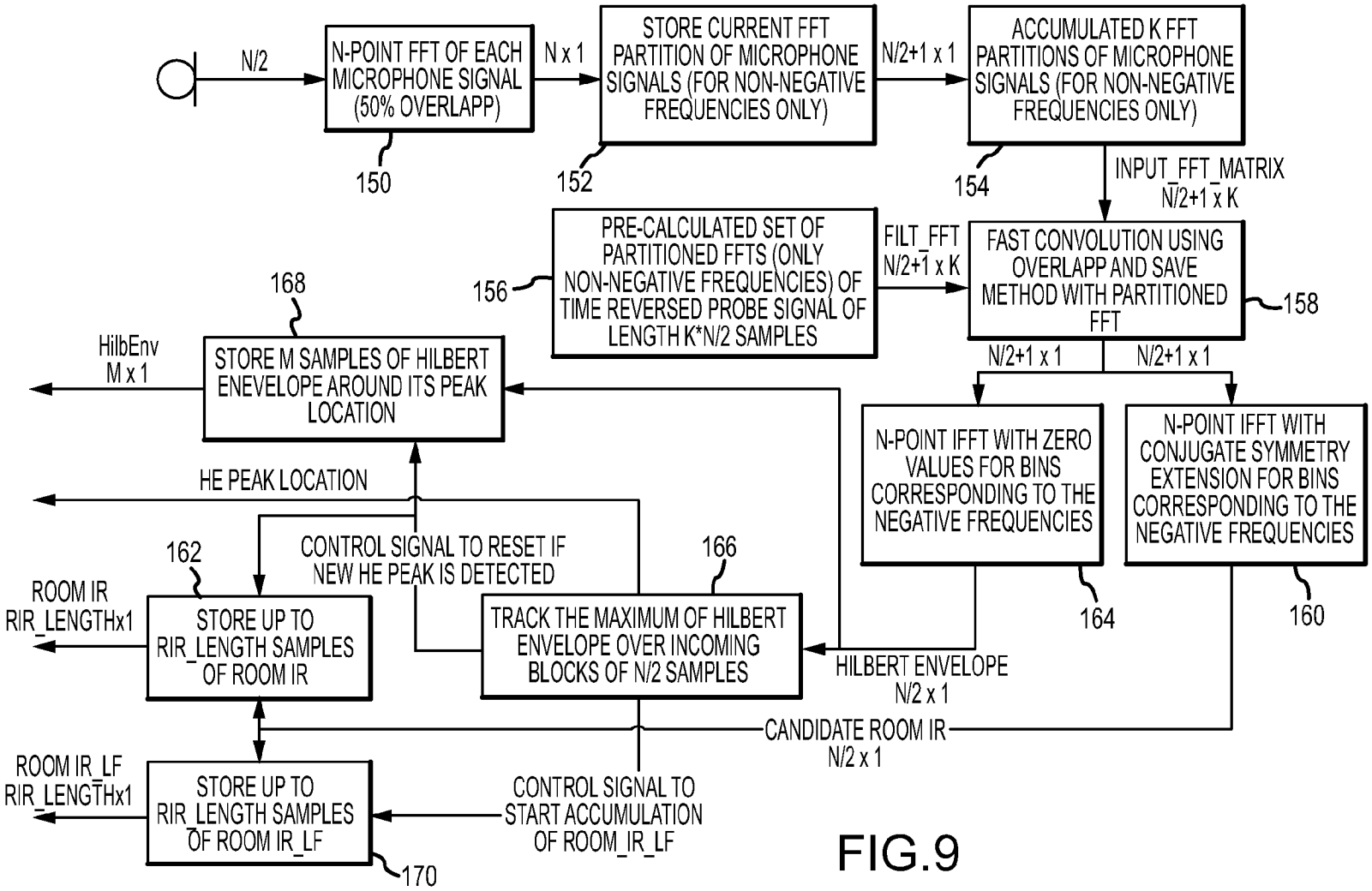
FIG. 9 is a block diagram of an embodiment for real-time acquisition processing of the probe signals to provide a room response and delays.

Referring now to FIG. 9, in a specific embodiment each successive block of N/2 samples (with a 50% overlap) is processed to update the RIR. An N-point FFT is performed on each block for each microphone to output a frequency response of length N×1 (step 150). The current FFT partition for each microphone signal (non-negative frequencies only) is stored in a vector of length (N/2+1)×1 (step 152). These vectors are accumulated in a first-in first-out (FIFO) bases to create a matrix Input_FFT_Matrix of K FFT partitions of dimensions (N/2+1)×K (step 154). A set of partitioned FFTs (non-negative frequencies only) of a time reversed broadband probe signal of length K*N/2 samples are pre-calculated and stored as a matrix Filt_FFT of dimensions (N/2+1)×K (step 156). A fast convolution using an overlap and save method is performed on the Input_FFT_Matrix with the Filt_FFT matrix to provide an N/2+1 point candidate frequency response for the current block (step 158). The overlap and save method multiplies the value in each frequency bin of the Filt_FFT_matrix by the corresponding value in the Input_FFT_Matrix and averages the values across the K columns of the matrix. For each block an N-point inverse FFT is performed with conjugate symmetry extension for negative frequencies to obtain a new block of N/2×1 samples of a candidate room impulse response (RIR) (step 160). Successive blocks of candidate RIRs are appended and stored up to a specified RIR length (RIR_Length) (step 162).

Also from the same candidate frequency response, by zeroing its values for negative frequencies, applying an IFFT to the result, and taking the absolute value of the IFFT, a new block of N/2×1 samples of the HE of the candidate room impulse response is obtained (step 164). The maximum (peak) of the HE over the incoming blocks of N/2 samples is tracked and updated to track a global peak over all blocks (step 166). M samples of the HE around its global peak are stored (step 168). If a new global peak is detected, a control signal is issued to flush the stored candidate RIR and restart. The DSP outputs the RIR, HE peak location and the M samples of the HE around its peak.

In an embodiment in which a dual-probe approach is used, the pre-emphasized probe signal is processed in the same manner to generate a candidate RIR that is stored up to RIR_Length (step 170). The location of the global peak of the HE for the all-pass probe signal is used to start accumulation of the candidate RIR. The DSP outputs the RIR for the pre-emphasized probe signal.

Room Response Processing

Once the acquisition process is completed the room responses are processed by a cochlear mechanics inspired time-frequency processing, where a long part of room response is considered at lower frequencies and progressively shorter parts of room response are considered at higher and higher in frequencies. This variable resolution time-frequency processing may be performed either on the time-domain RIR or the frequency-domain spectral measure.

Figure 10:
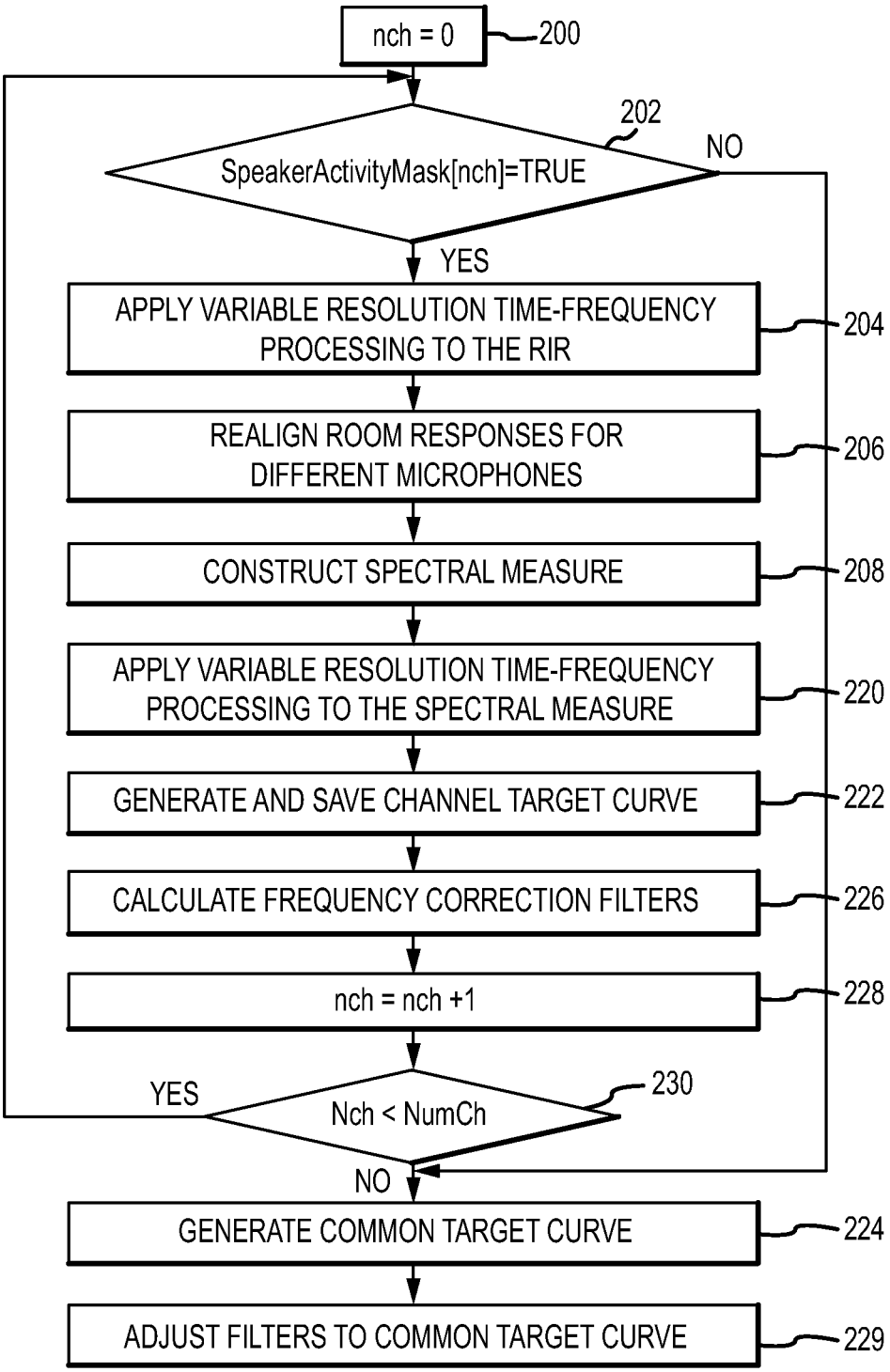
FIG. 10 is a flow diagram of an embodiment for post-processing of the room response to provide the correction filters.
Figure 11:
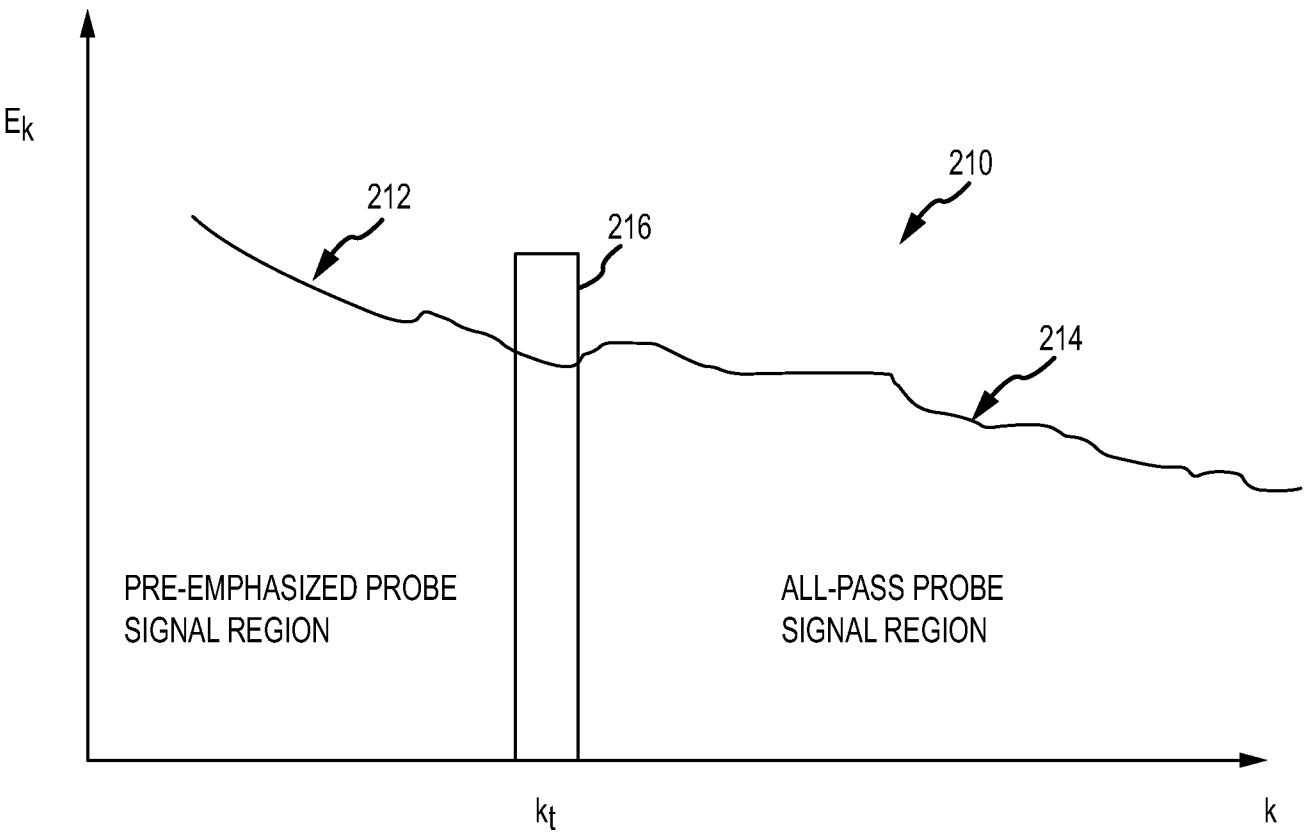
FIG. 11 is a diagram of an embodiment of a room spectral measure blended from the spectral measures of a broadband probe signal and a pre-emphasized probe signal.

An embodiment of the method of room response processing is illustrated in FIG. 10. The audio channel indicator nch is set to zero (step 200). If the SpeakerAvtivityMask[nch] is not true (i.e. no more loudspeakers coupled) (step 202) the loop processing terminates and skips to the final step of adjusting all correction filters to a common target curve. Otherwise the process optionally applies variable resolution time-frequency processing to the RIR (step 204). A time varying filter is applied to the RIR. The time varying filter is constructed so that the beginning of the RIR is not filtered at all but as the filter progresses in time through the RIR a low pass filter is applied whose bandwidth becomes progressive smaller with time.

An exemplary process for constructing and applying the time varying filter to the RIR is as follows:

- Leave the first few milliseconds of RIR unaltered (all frequencies present)
- Few milliseconds into the RIR start applying a time-varying low pass filter to the RIR
- The time variation of low-pass filter may be done in stages:
  - each stage corresponds to the particular time interval within the RIR
  - this time interval may be increased by factor of 2× when compared to the time interval in previous stage
  - time intervals between two consecutive stages may be overlapping by 50% (of the time interval corresponding to the earlier stage)
  - at each new stage the low pass filter may reduce its bandwidth by 50%
- The time interval at initial stages shall be around few milliseconds.
- Implementation of time varying filter may be done in FFT domain using overlap-add methodology; In particular:

extract a portion of the RIR corresponding to the current block apply a window function to the extracted block of RIR, apply an FFT to the current block, multiply with corresponding frequency bins of the same size FFT of the current stage low-pass filter compute an inverse FFT of the result to generate an output, extract a current block output and add the saved output from the previous block save the remainder of the output for combining with the next block These steps are repeated as the "current block" of the RIR slides in time through the RIR with a 50% overlap with respect to the previous block.

The length of the block may increase at each stage (matching the duration of time interval associated with the stage), stop increasing at a certain stage or be uniform throughout.

The room responses for different microphones are realigned (step 206). In the case of a single microphone no realignment is required. If the room responses are provide in the time domain as a RIR, they are realigned such that the relative delays between RIRs in each microphone are restored and a FFT is calculated to obtain aligned RFR. If the room responses are provided in the frequency domain as a RFR, realignment is achieved by a phase shift corresponding to the relative delay between microphone signals. The frequency response for each frequency bin k for the all-pass probe signal is $H_k$ and for the pre-emphasized probe signal is $H_{k,pe}$ where the functional dependency on frequency has been omitted.

A spectral measure is constructed from the realigned RFRs for the current audio channel (step 208). In general the spectral measure may be calculated in any number of ways from the RFRs including but not limited to a magnitude spectrum and an energy measure. As show in FIG. 11, the spectral measure 210 may blend a spectral measure 212 calculated from the frequency response $H_{k,pe}$ for the pre-emphasized probe signal for frequencies below a cut-off frequency bin $k_t$ and a spectral measure 214 from the frequency response $H_k$ for the broadband probe signal for frequencies above the cut-off frequency bin $k_t$. In the simplest case, the spectral measures are blended by appending the $H_k$ above the cut-off to the $H_{k,pe}$ below the cut-off. Alternately, the different spectral measures may be combined as a weighted average in a transition region 216 around the cut-off frequency bin if desired.

If variable resolution time-frequency processing was not applied to the room responses in step 204, variable resolution time-frequency processing may be applied to the spectral measure (step 220). A smoothing filter is applied to the spectral measure. The smoothing filter is constructed so that the amount of smoothing increases with frequency.

An exemplary process for constructing and applying the smoothing filter to the spectral measure comprises using a single pole low pass filter difference equation and applying it to the frequency bins. Smoothing is performed in 9 frequency bands (expressed in Hz): Band 1: 0-93.8, Band 2: 93.8-187.5, Band 3:187.5-375, Band 4: 375-750, Band 5: 750-500, Band 6:1500-3000, Band 7: 3000-6000, Band 8: 6000-12000 and Band 9: 12000-24000. Smoothing uses forward and backward frequency domain averaging with variable exponential forgetting factor. The variability of exponential forgetting factor is determined by the bandwidth of the frequency band (Band_BW) i.e. Lamda=1−C/Band_BW with C being a scaling constant. When transitioning from one band to next the value of Lambda is obtained by linear interpolation between the values of Lambda in these two bands.

Once the final spectral measure has been generated, the frequency correction filters can be calculated. To do so, the system must be provided with a desired corrected frequency response or "target curve". This target curve is one of the main contributors to the characteristic sound of any room correction system. One approach is to use a single common target curve reflecting any user preferences for all audio channels. Another approach reflected in FIG. 10 is to generate and save a unique channel target curve for each audio channel (step 222) and generate a common target curve for all channels (step 224).

For correct stereo or multichannel imaging, a room correction process should first of all achieve matching of the first arrival of sound (in time, amplitude and timbre) from each of the loudspeakers in the room. The room spectral measure is smoothed with a very coarse low pass filter such that only the trend of the measure is preserved. In other words the trend of direct path of a loudspeaker response is preserved since all room contributions are excluded or smoothed out. These smoothed direct path loudspeaker responses are used as the channel target curves during the calculation of frequency correction filters for each loudspeaker separately (step 226). As a result only relatively small order correction filters are required since only peaks and dips around the target need to be corrected. The audio channel indicator nch is incremented by one (step 228) and tested against the total number of channels NumCh to determine if all possible audio channels have been processed (step 230). If not, the entire process repeats for the next audio channel. If yes, the process proceeds to make final adjustments to the correction filters for the common target curve.

In step 224, the common target curve is generated as an average of the channel target curves over all loudspeakers. Any user preferences or user selectable target curves may be superimposed on the common target curve. Any adjustments to the correction filters are made to compensate for differences in the channel target curves and the common target curve (step 229). Due to the relatively small variations between the per channel and common target curves and the highly smoothed curves, the requirements imposed by the common target curve can be implemented with very simple filters.

Figure 12:
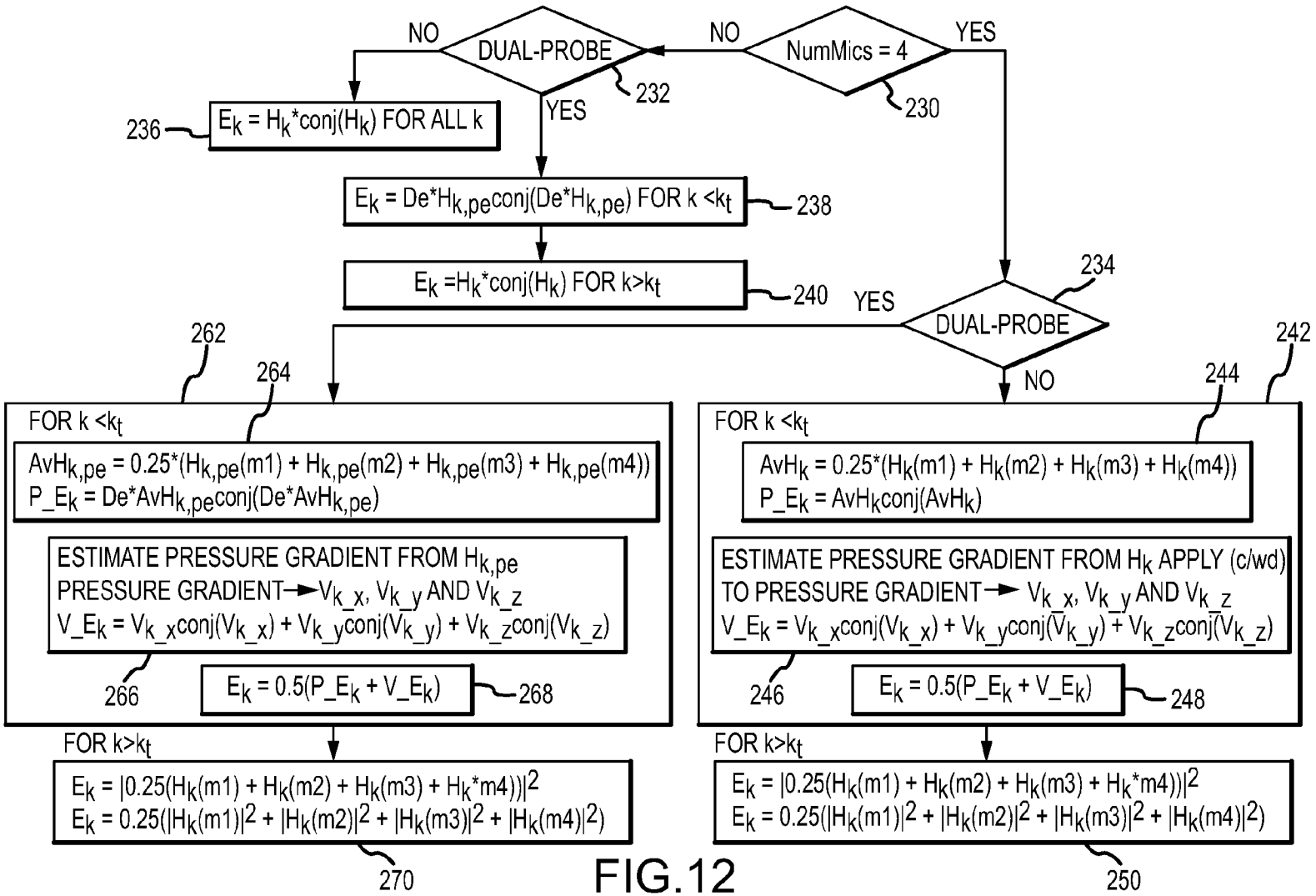
FIG. 12 is a flow diagram of an embodiment for computing the energy measure for different probe signal and microphone combinations.
Figure 13:
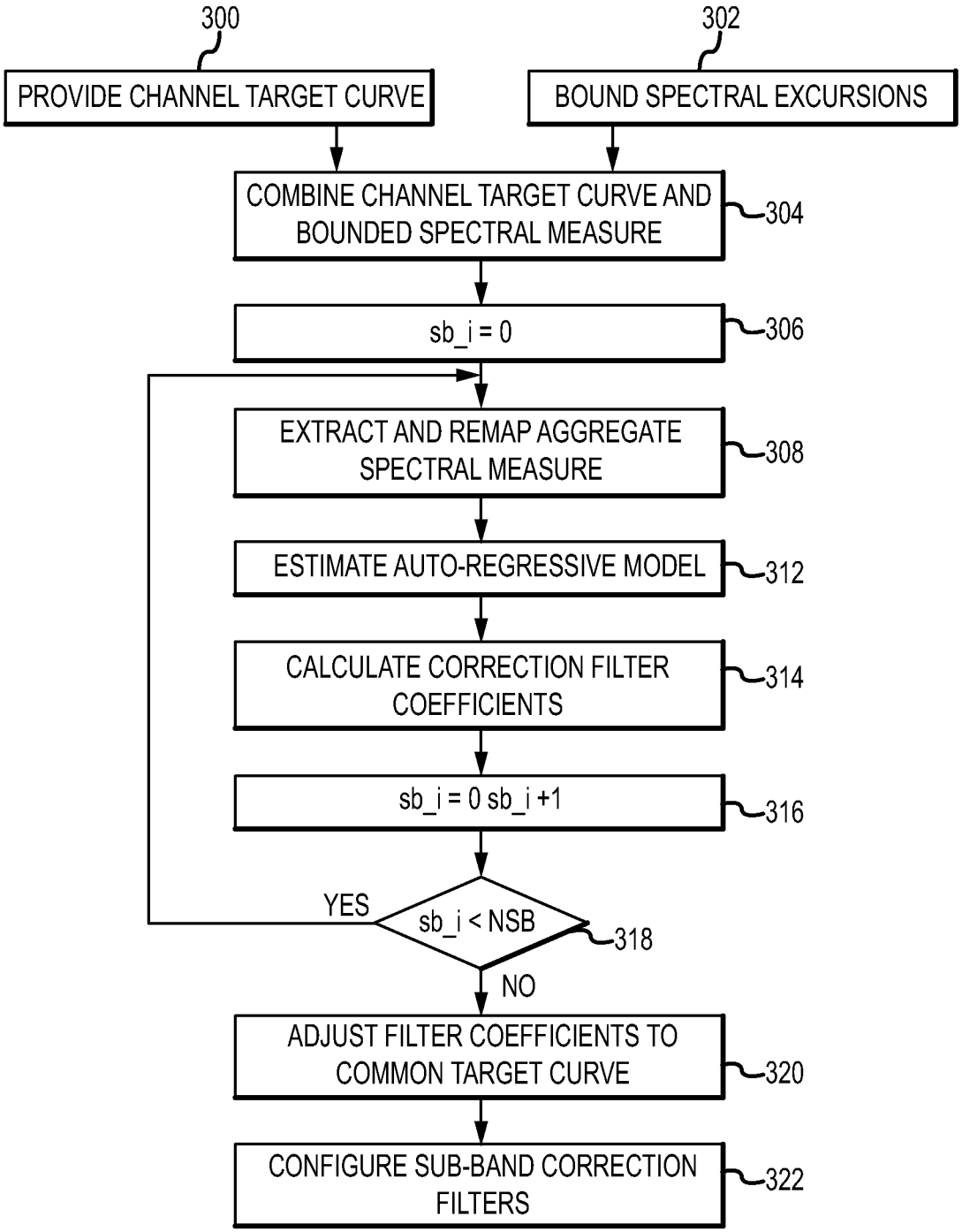
FIG. 13 is a flow diagram of an embodiment for processing the energy measure to calculate frequency correction filters.

As mentioned previously the spectral measure computed in step 208 may constitute an energy measure. An embodiment for computing energy measures for various combinations of a single microphone or a tetrahedral microphone and a single probe or a dual probe is illustrated in FIG. 12.

The analysis module determines whether there is 1 or 4 microphones (step 230) and then determines whether there is a single or dual-probe room response (step 232 for a single microphone and step 234 for a tetrahedral microphone). This embodiment is described for 4 microphones, more generally the method may be applied to any multi-microphone array.

For the case of a single microphone and single probe room response $H_k$, the analysis module constructs the energy measure $E_k$ (functional dependent on frequency omitted) in each frequency bin k as $E_k$=Hk*conj($H_k$) where conj(*) is the conjugate operator (step 236). Energy measure $E_k$ corresponds to the sound pressure.

For the case of a single microphone and dual probe room responses $H_k$ and $H_{k,pe}$, the analysis module constructs the energy measure $E_k$ at low frequency bins $k<k_t$ as $E_k$=De* $H_{k,pe}$conj(De*$H_{k,pe}$) where De is the complementary de-emphasis function to the pre-emphasis function Pe (i.e. De*Pe=1 for all frequency bins k) (step 238). For example, the pre-emphasis function Pe=c/ωd and the de-emphasis function De=ωd/c. At high frequency bins $k>k_t$ $E_k=H_k$*conj($H_k$) (step 240). The effect of using the dual-probe is to attenuate low frequency noise in the energy measure.

For the tetrahedral microphone cases, the analysis module computes a pressure gradient across the microphone array from which sound velocity components may be extracted. As will be detailed, an energy measure based on both sound pressure and sound velocity for low frequencies is more robust across a wider listening area.

For the case of a tetrahedral microphone and a single probe response $H_k$, at each low frequency bin $k<k_t$ a first part of the energy measure includes a sound pressure component and a sound velocity component (step 242). The sound pressure component $P_E_k$ may be computed by averaging the frequency response over all microphones $AvH_k=0.25*(H_k(m1)+H_k(m2)+H_k(m3)+H_k(m4))$ and computing $P_E_k=AvH_k conj(AvH_k)$ (step 244). The "average" may be computed as any variation of a weighted average. The sound velocity component $V_H_k$ is computed by estimating a pressure gradient $\widehat{\nabla P}$ from the $H_k$ for all 4 microphones, applying a frequency dependent weighting (c/ωd) to $\widehat{\nabla P}$ to obtain velocity components $V_{k_x}$, $V_{k_y}$ and $V_{k_z}$ along the x, y and z coordinate axes, and computing $V_E_k=V_{k_x}conj(V_{k_x})+V_{k_y}conj(V_{k_y})+V_{k_z}conj(V_{k_z})$ (step 246). The application of frequency dependent weighting will have the effect of amplifying noise at low frequencies. The low frequency portion of the energy measure $E_K=0.5(P_E_k+V_E_k)$ (step 248) although any variation of a weighted average may be used. The second part of the energy measure at each high frequency bin $k>k_t$ is computed as the square of the sums $E_K=|0.25(H_k(m1)+H_k(m2)+H_k(m3)+H_k(m4))|^2$ or the sum of the squares $E_K=|0.25(|H_k(m1)|^2+|H_k(m2)|^2+|H_k(m3)|^2+|H_k(m4)|^2)$ for example (step 250).

For the case of a tetrahedral microphone and a dual-probe response $H_k$ and $H_{k,pe}$, at each low frequency bin $k<k_t$ a first part of the energy measure includes a sound pressure component and a sound velocity component (step 262). The sound pressure component $P_E_k$ may be computed by averaging the frequency response over all microphones $AvH_{k,pe}=0.25*(H_{k,pe}(m1)+H_{k,pe}(m2)+H_{k,pe}(m3)+H_{k,pe}(m4))$, apply de-emphasis scaling and computing $P_E_k=De*AvH_{k,pe}conj(De*AvH_{k,pe})$ (step 264). The "average" may be computed as any variation of a weighted average. The sound velocity component $V_H_{k,pe}$ is computed by estimating a pressure gradient $\widehat{\nabla P}$ from the $H_{k,pe}$ for all 4 microphones, estimating velocity components $V_{k_x}$, $V_{k_y}$ and $V_{k_z}$ along the x, y and z coordinate axes from $\widehat{\nabla P}$, and computing $V_E_k=V_{k_x}conj(V_{k_x})+V_{k_y}conj(V_{k_y})+V_{k_z}conj(V_{k_z})$ (step 266). The use of the pre- emphasized probe signal removes the step of applying frequency dependent weighting. The low frequency portion of the energy measure $E_K=0.5(P_E_k+V_E_k)$ (step 268) (or other weighted combination). The second part of the energy measure at each high frequency bin k>k may be computed as the square of the sums $E_K=|0.25(H_k(m1)+H_k(m2)+H_k(m3)+H_k(m4))|^2$ or the sum of the squares $E_K=|0.25(|H_k(m1)|^2+|H_k(m2)|^2+|H_k(m3)|^2+|H_k(m4)|^2)$ for example (step 270). The dual-probe, multi-microphone case combines both forming the energy measure from sound pressure and sound velocity components and using the pre-emphasized probe signal in order to avoid the frequency dependent scaling to extract the sound velocity components, hence provide a sound velocity that is more robust in the presence of noise.

A more rigorous development of the methodology for constructing the energy measure, and particularly the low frequency component of the energy measure, for the tetrahedral microphone array using either single or dual-probe techniques follows. This development illustrates both the benefits of the multi-microphone array and the use of the dual-probe signal.

In an embodiment, at low frequencies, the spectral density of the acoustic energy density in the room is estimated. Instantaneous acoustic energy density, at the point, is given by:

$$e_D(r,t)=\frac{p(r,t)^2}{2\rho c^2}+\frac{\rho\|u(r,t)\|^2}{2} \tag{1}$$

where all variables marked in bold represent vector variables, the p(r,t) and u(r,t) are instantaneous sound pressure and sound velocity vector, respectively, at location determined by position vector r, c is the speed of sound, and p is the mean density of the air. The ||U|| is indicating the l2 norm of vector U. If the analysis is done in frequency domain, via the Fourier transform, then $$E_D(r,w)=\frac{|P(r,w)|^2}{2\rho c^2}+\frac{\rho\|U(r,w)\|^2}{2} \tag{2}$$

$$\text{where } Z(r,w)=\mathcal{F}(z(r,t))=\int_{-\infty}^{\infty}z(r,t)e^{jwt}.$$

The sound velocity at location $r(r_x,r_y,r_z)$ is related to the pressure using the linear Euler's equation, $$\rho\frac{\partial u(r,t)}{\partial t}=-\nabla p(r,t)=-\begin{bmatrix}\frac{\partial p(r,t)}{\partial x}\\ \frac{\partial p(r,t)}{\partial y}\\ \frac{\partial p(r,t)}{\partial z}\end{bmatrix} \tag{3}$$

and in the frequency domain $$jw\rho U(r,w)=-\nabla P(r,w)=-\begin{bmatrix}\frac{\partial P(r,w)}{\partial x}\\ \frac{\partial P(r,w)}{\partial y}\\ \frac{\partial P(r,w)}{\partial z}\end{bmatrix} \tag{4}$$

The term ∇P(r,w) is a Fourier transform of a pressure gradient along x, y and z coordinates at frequency ω. Hereafter, all analysis will be conducted in the frequency domain and the functional dependency on w indicating the Fourier transform will be omitted as before. Similarly functional dependency on location vector r will be omitted from notation.

With this the expression for desired energy measure at each frequency in desired low frequency region can be written as $$E = \rho c^2 E_D = \frac{|P|^2}{2} + \frac{\left\|\frac{c}{w}\nabla P\right\|}{2} \tag{5}$$

The technique that uses the differences between the pressures at multiple microphone locations to compute the pressure gradient has been described Thomas, D. C. (2008). *Theory and Estimation of Acoustic Intensity and Energy Density*. MSc. Thesis, Brigham Young University. This pressure gradient estimation technique for the case of tetrahedral microphone array and for specially selected coordinate system shown in FIG. 1*b* is presented. All microphones are assumed to be omnidirectional i.e., the microphone signals represent the pressure measurements at different locations.

A pressure gradient may be obtained from the assumption that the microphones are positioned such that the spatial variation in the pressure field is small over the volume occupied by the microphone array. This assumption places an upper bound on the frequency range at which this assumption may be used. In this case, the pressure gradient may be approximately related to the pressure difference between any microphone pair by:

$$r_{kl}^T \cdot \nabla \approx P_{kl} = P_l - P_k$$

where $P_k$ is a pressure component measured at microphone k, $r_{kl}$ is a vector pointing from microphone k to microphone 1 i.e., $$r_{kl} = r_l - r_k = \begin{bmatrix} r_{lx} - r_{kx} \\ r_{ly} - r_{ky} \\ r_{lz} - r_{kz} \end{bmatrix},$$

T denotes matrix transpose operator and • denotes a vector dot product. For particular the microphone array and particular selection of the coordinate system the microphone position vectors are $r_1=[0\ 0\ 0]^T$, $$r_2 = d\begin{bmatrix} -\frac{\sqrt{3}}{2} & 0.5 & 0 \end{bmatrix}^T, r_3 = d\begin{bmatrix} -\frac{\sqrt{3}}{2} & -0.5 & 0 \end{bmatrix}^T \text{ and}$$

$$r_4 = d\begin{bmatrix} -\frac{\sqrt{3}}{3} & 0 & \frac{\sqrt{6}}{3} \end{bmatrix}^T.$$

Considering all 6 possible microphone pairs in the tetrahedral array an over determined system of equations can be solved for unknown components (along x, y and z coordinates) of a pressure gradient by means of a least squares solution. In particular if all equations are grouped in a matrix form the following matrix equation is obtained:

$$R \cdot \nabla P = P + \Delta \tag{6}$$

with $$R = \frac{1}{d}[\, r_{12} \quad r_{13} \quad r_{14} \quad r_{23} \quad r_{24} \quad r_{34} \,]^T,$$

$$P = [\, P_{12} \quad P_{13} \quad P_{14} \quad P_{23} \quad P_{24} \quad P_{34} \,]^T$$

and Δ is an estimation error. The pressure gradient $\widehat{\nabla P}$ that minimizes the estimation error in a least square sense is obtained as follows $$\widehat{\nabla P} = \frac{1}{d}(R^T R)^{-1} R^T P \tag{7}$$

where the $(R^T R)^{-1} R^T$ is left pseudo inverse of matrix R. The matrix R is only dependant on selected microphone array geometry and selected origin of a coordinate system. The existence of its pseudo inverse is guaranteed as long as the number of microphones is greater than the number of dimensions. For estimation of the pressure gradient in 3D space (3 dimensions) at least 4 microphones are required.

There are several issues that need to be considered when it comes to applicability of the above described method to the real life measurements of a pressure gradient and ultimately sound velocity:

The method uses phase matched microphones, although the effect of slight phase mismatch for constant frequency decreases as the distance between the microphones increases.

The maximum distance between the microphones is limited by the assumption that spatial variation in the pressure field is small over the volume occupied by the microphone array implying that the distance between the microphones shall be much less than a wavelength, λ of the highest frequency of interest. It has been suggested by Fahy, F. J. (1995). *Sound Intensity, 2nd ed*. London: E & FN Spon that the microphone separation, in methods using finite difference approximation for estimation of a pressure gradient, should be less than 0.13 to avoid errors in the pressure gradient greater than 5%.

Considering that in real life measurements noise is always present in microphone signals especially at low frequencies the gradient becomes very noisy. The difference in pressure due to sound wave coming from a loudspeaker at different microphone locations becomes very small at low frequencies, for the same microphone separation. Considering that for velocity estimation the signal of interest is the difference between two microphones at low frequencies the effective signal to noise ratio is reduced when compared to original SNR in microphone signals. To make things even worse, during the calculation of velocity signals, these microphone difference signals are weighted by a function that is inverse proportional to the frequency effectively causing noise amplification. This imposes a lower bound on a frequency region, in which the methodology for velocity estimation, based on the pressure difference between the spaced microphones, can be applied.

Room correction should be implemented in variety of consumer AV equipment in which great phase matching between different microphones in a microphone array cannot be assumed. Consequently the microphone spacing should be as large as possible.

For room correction the interest is in obtaining pressure and velocity based energy measure in a frequency region between 20 Hz and 500 Hz where the room modes have dominating effect. Consequently spacing between the microphone capsules that does not exceed approximately 9 cm (0.13*340/500 m) is appropriate.

Consider a received signal at pressure microphone k and at its Fourier transform $P_k(w)$. Consider a loudspeaker feed signal S(w) (i.e., probe signal) and characterize transmission of a probe signal from a loudspeaker to microphone k with the room frequency response $H_k$ (w). Then the $P_k$ (w)=S(w) $H_k$ (w)+$N_k$ (N) where $N_k$ (w) is a noise component at microphone k. For simplicity of notation in the following equations the dependency on w i.e. $P_k$ (N) will simply be denoted as $P_k$ etc.

For the purpose of a room correction the goal is to find a representative room energy spectrum that can be used for the calculation of frequency correction filters. Ideally if there is no noise in the system the representative room energy spectrum (RmES) can be expressed as $$RmES = \frac{\hat{E}}{|S|^2} = \frac{|P|^2}{2|S|^2} + \frac{\left\|\frac{c}{w}\tilde{\nabla}\tilde{P}\right\|^2}{2|S|^2} = \frac{|H_1+H_2+H_3+H_4|^2}{32} + \frac{1}{2}\left\|\frac{c}{wd}(R^TR)^{-1}R^T\begin{bmatrix}(H_2-H_1)\\(H_3-H_1)\\(H_4-H_1)\\(H_3-H_2)\\(H_4-H_2)\\(H_4-H_3)\end{bmatrix}\right\|^2 \quad (1)$$

In reality noise will always be present in the system and an estimate of RmES can be expressed as $$RmES \approx R\widehat{mES} = \frac{\left|H_1+H_2+H_3+H_4+\frac{N_1+N_2+N_3+N_4}{S}\right|^2}{32} + \frac{1}{2}\left\|\frac{c}{wd}(R^TR)^{-1}R^T\begin{bmatrix}(H_2-H_1)+\frac{N_2-N_1}{S}\\(H_3-H_1)+\frac{N_3-N_1}{S}\\(H_4-H_1)+\frac{N_4-N_1}{S}\\(H_3-H_2)+\frac{N_3-N_2}{S}\\(H_4-H_2)+\frac{N_4-N_2}{S}\\(H_4-H_3)+\frac{N_4-N_3}{S}\end{bmatrix}\right\|^2 \quad (2)$$

At very low frequencies the magnitude squared of the differences between frequency responses from a loudspeaker to closely spaced microphone capsules i.e., $|H_k-H_l|^2$ is very small. On the other hand, the noise in different microphones may be considered uncorrelated and consequently $|N_k-N_l|^2 \neq |N_k|^2+|N_l|^2$. This effectively reduces the desired signal to noise ratio and makes the pressure gradient noisy at low frequencies. Increasing the distance between the microphones will make the magnitude of desired signal $(H_k-H_l)$ larger and consequently improve the effective SNR.

The frequency weighting factor $$\frac{c}{wd}$$

for all frequencies of interest is >1 and it effectively amplifies the noise with a scale that is inversely proportional to the frequency. This introduces upward tilt in $\widehat{RmES}$ as towards lower frequencies. To prevent this low frequency tilt in estimated energy measure $\widehat{RmES}$ the pre-emphasized probe signal is used for room probing at low frequencies. In particular the pre-emphasized probe signal $$S_{pe} = \frac{c}{wd}S.$$

Furthermore when extracting room responses from the microphone signals, de-convolution is performed not with the transmitted probe signal $S_{pe}$ but rather with the original probe signal S. The room responses extracted in that manner will have the following form $$H_{k,pe} = \frac{c}{wd}H_k + \frac{N_k}{S}.$$

Consequently the modified form of the estimator for the energy measure is $$RmES \approx R\widetilde{mES}_{pe} = \frac{\left|\frac{wd}{c}(H_{1,pe}+H_{2,pe}+H_{3,pe}+H_{4,pe})\right|^2}{32} + \frac{1}{2}\left\|(R^TR)^{-1}R^T\begin{bmatrix}(H_{2,pe}-H_{1,pe})\\(H_{3,pe}-H_{1,pe})\\(H_{4,pe}-H_{1,pe})\\(H_{3,pe}-H_{2,pe})\\(H_{4,pe}-H_{2,pe})\\(H_{4,pe}-H_{3,pe})\end{bmatrix}\right\|^2 \quad (3)$$

To observe its behavior regarding noise amplification the energy measure is written as $$RmES \approx R\widetilde{mES}_{pe} = \frac{\left|H_1+H_2+H_3+H_4+\frac{wd(N_1+N_2+N_3+N_4)}{S}\right|^2}{32} + \frac{1}{2}\left\|(R^TR)^{-1}R^T\begin{bmatrix}\frac{c}{wd}(H_2-H_1)+\frac{N_2-N_1}{S}\\\frac{c}{wd}(H_3-H_1)+\frac{N_3-N_1}{S}\\\frac{c}{wd}(H_4-H_1)+\frac{N_4-N_1}{S}\\\frac{c}{wd}(H_3-H_2)+\frac{N_3-N_2}{S}\\\frac{c}{wd}(H_4-H_2)+\frac{N_4-N_2}{S}\\\frac{c}{wd}(H_4-H_3)+\frac{N_4-N_3}{S}\end{bmatrix}\right\|^2 \quad (4)$$

With this estimator noise components entering the velocity estimate are not amplified by $$\frac{c}{wd}$$

and in amnion me noise components entering the pressure estimate are attenuated by $$\frac{c}{wd}$$

hence improving the SNR of pressure microphone. As stated before this low frequency processing is applied in frequency region from 20 Hz to around 500 Hz. Its goal is to obtain an energy measure that is representative of a wide listening area in the room. At higher frequencies the goal is to characterize the direct path and few early reflections from the loudspeaker to the listening area. These characteristics mostly depend on loudspeaker construction and its position within the room and consequently do not vary much between different locations within the listening area. Therefore at high frequencies an energy measure based on a simple average (or more complex weighted average) of tetrahedral microphone signals is used. The resulting overall room energy measure is written as in Equation (12).

$$RmEn = \begin{cases} \dfrac{\left|\dfrac{wd}{c}\begin{pmatrix} H_{1,pe} + H_{2,pe} + \\ H_{3,pe} + H_{4,pe} \end{pmatrix}\right|^2}{32} + \\ \dfrac{1}{2}\left\|(R^T R)^{-1} R^T \begin{bmatrix} (H_{2,pe} - H_{1,pe}) \\ (H_{3,pe} - H_{1,pe}) \\ (H_{4,pe} - H_{1,pe}) \\ (H_{3,pe} - H_{2,pe}) \\ (H_{4,pe} - H_{2,pe}) \\ (H_{4,pe} - H_{3,pe}) \end{bmatrix}\right\|^2, & \text{for } w \le w_T \\ \dfrac{|H_1|^2 + |H_2|^2 + |H_3|^2 + |H_4|^2}{4}, & \text{for } w > w_T = 2\pi f_T \end{cases} \quad (5)$$

These equations relate directly to the cases for constructing the energy measures $E_k$ for the singe-probe and dual-probe tetrahedral microphone configurations. In particular, equation 8 corresponds to step 242 for computing the low-frequency component of $E_k$. The $1^{st}$ term in equation 8 is the magnitude squared of the average frequency response (step 244) and the $2^{nd}$ term applies the frequency dependent weighting to the pressure gradient to estimate the velocity components and computes the magnitude squared (step 246). Equation 12 corresponds to steps 260 (low-frequency) and 270 (high-frequency). The $1^{st}$ term in equation 12 is the magnitude square of the de-emphasized average frequency response (step 264). The $2^{nd}$ term is the magnitude squared of the velocity components estimated from the pressure gradient. For both the single and dual-probe cases, the sound velocity component of the low-frequency measure is computed directly from the measured room response $H_k$ or $H_{k,pe}$, the steps of estimating the pressure gradient and obtaining the velocity components are integrally performed.

Sub-Band Frequency Correction Filters

The construction of minimum-phase FIR sub-band correction filters is based on AR model estimation for each band independently using the previously described room spectral (energy) measure. Each band can be constructed independently because the analysis/synthesis filter banks are non-critically sampled.

Referring now to FIGS. 13 and 14*a*-14*c*, for each audio channel and loudspeaker a channel target curve is provided (step 300). As described previously, the channel target curve may be calculated by applying frequency smoothing to the room spectral measure, selecting a user defined target curve or by superimposing a user defined target curve onto the frequency smoothed room spectral measure. Additionally, the room spectral measure may be bounded to prevent extreme requirements on the correction filters (step 302). The per channel mid-band gain may be estimated as an average of the room spectral measure over the mid-band frequency region. Excursions of the room spectrum measure are bounded between a maximum of the mid-band gain plus an upper bound (e.g. 20 dB) and a minimum of the mid-band gain minus a lower bound (e.g. 10 dB). The upper bound is typically larger than the lower bound to avoid pumping excessive energy into the a frequency band where the room spectral measure has a deep null. The per channel target curve is combined with the bounded per channel room spectral measure to obtain an aggregate room spectral measure 303 (step 304). In each frequency bin, the room spectral measure is divided by the corresponding bin of the target curve to provide the aggregate room spectral measure. A sub-band counter sb is initialized to zero (step 306).

Figure 14A:
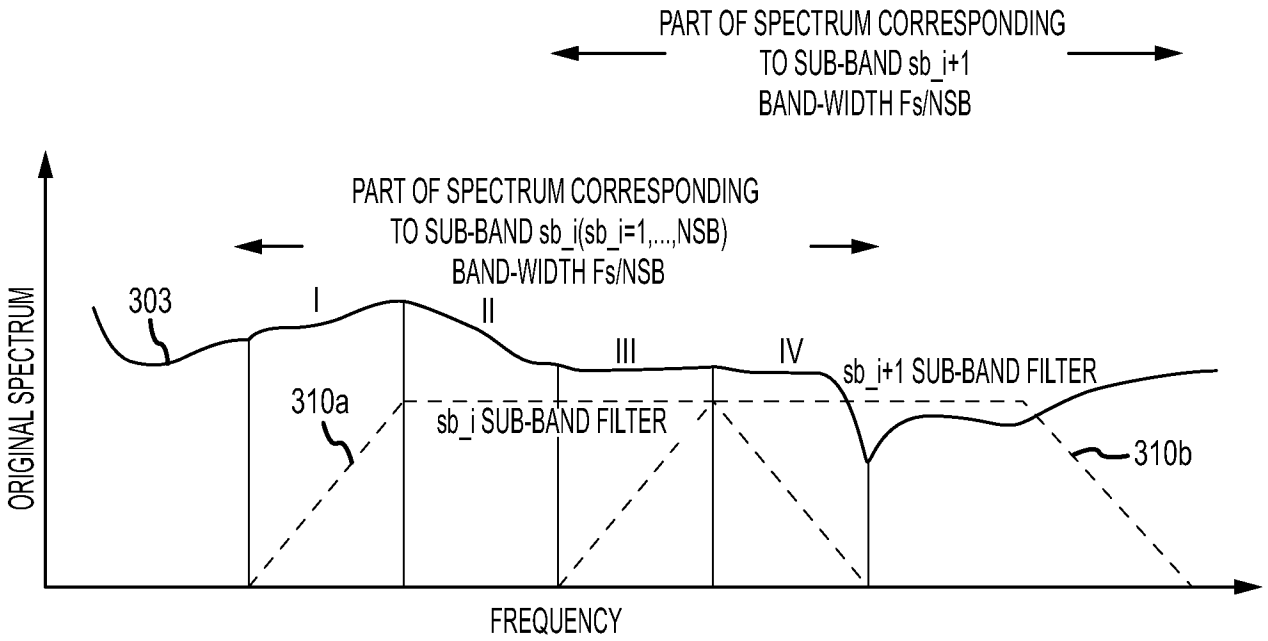
FIGS. 14*a* through 14*c* are diagrams illustrating an embodiment for the extraction and remapping of the energy measure to base-band to mimic the downsampling of the analysis filter bank.
Figure 14B:
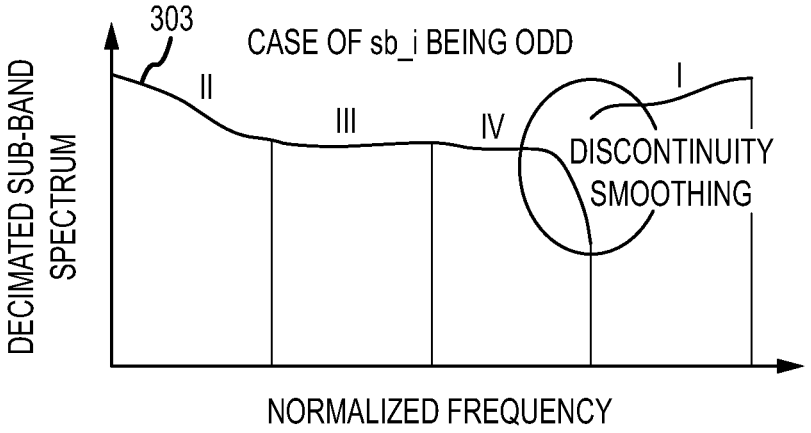
Figure 14C:
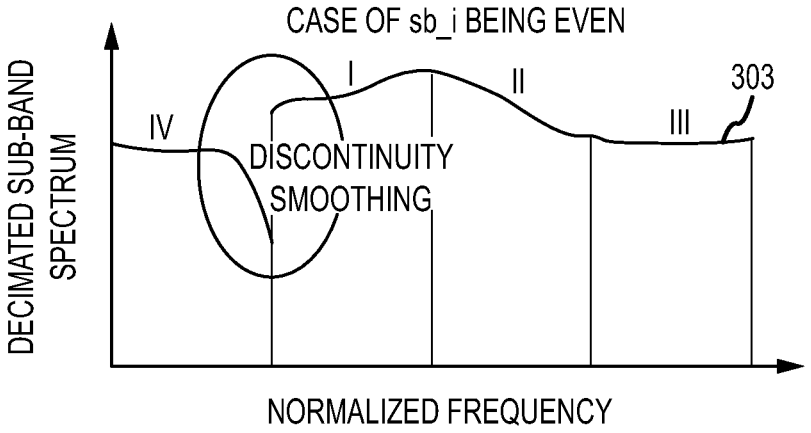

Portions of the aggregate spectral measure are extracted that correspond to different sub-bands and remapped to base-band to mimic the downsampling of the analysis filter bank (step 308). The aggregate room spectral measure 303 is partitioned into overlapping frequency regions 310*a*, 310*b* and so forth corresponding to each band in the oversampled filter bank. Each partition is mapped to the base-band according to decimation rules that apply for even and odd filter bank bands as shown in FIGS. 14*c* and 14*b*, respectively. Notice that the shapes of analysis filters are not included into the mapping. This is important because it is desirable to obtain correction filters that have as low order as possible. If the analysis filter bank filters are included the mapped spectrum will have steep falling edges. Hence the correction filters would require high order to unnecessarily correct for a shape of analysis filters.

After mapping to base-band the partitions corresponding to the odd or even will have parts of the spectrum shifted but some other parts also flipped. This may result in spectral discontinuity that would require a high order frequency correction filter. In order to prevent this unnecessary increase of correction filter order, the region of flipped spectrum is smoothed. This in return changes the fine detail of the spectrum in the smoothed region. However it shall be noted that the flipped sections are always in the region where synthesis filters already have high attenuation and consequently the contribution of this part of the partition to the final spectrum is negligible.

An auto regressive (AR) model is estimated to the remapped aggregate room spectral measure (step 312). Each partition of room spectral measure after being mapped to the base band, mimicking the effect of decimation, is interpreted as some equivalent spectrum. Hence its inverse Fourier transform will be a corresponding autocorrelation sequence. This autocorrelation sequence is used as the input to the Levinson-Durbin algorithm which computes an AR model, of desired order, that best matches the given energy spectrum in a least square sense. The denominator of this AR model (all-pole) filter is a minimum phase polynomial. The length of frequency correction filters in each sub-band are roughly determined by the length of room response, in the corresponding frequency region, that we have considered during the creation of overall room energy measure (length proportionally goes down as we move from low to high frequencies). However the final lengths can either be fine tuned empirically or automatically by use of AR order selection algorithms that observe the residual power and stop when a desired resolution is reached.

The coefficients of the AR are mapped to coefficients of a minimum-phase all-zero sub-band correction filter (step 314). This FIR filter will perform frequency correction according to the inverse of the spectrum obtained by the AR model. To match filters between different bands all of the correction filters are suitably normalized.

The sub-band counter sb is incremented (step 316) and compared to the number of sub-bands NSB (step 318) to repeat the process for the next audio channel or to terminate the per channel construction of the correction filters. At this point, the channel FIR filter coefficients may be adjusted to a common target curve (step 320). The adjusted filter coefficients are stored in system memory and used to configure the one or more processors to implement the P digital FIR sub-band correction filters for each audio channel shown in FIG. 3 (step 322).

APPENDIX A

Loudspeaker Localization

For fully automated system calibration and set-up it is desirable to have knowledge of the exact location and number of loudspeakers present in the room. The distance can be computed based on estimated propagation delay from the loudspeaker to the microphone array. Assuming that the sound wave propagating along the direct path between loudspeaker and microphone array can be approximated by a plane wave then the corresponding angle of arrival (AOA), elevation, with respect to an origin of a coordinate system defined by microphone array, can be estimated by observing the relationship between different microphone signals within the array. The loudspeaker azimuth and elevation are calculated from the estimated AOA.

It is be possible to use frequency domain based AOA algorithms, in principle relying on the ratio between the phases in each bin of the frequency responses from a loudspeaker to each of the microphone capsules, to determine AOA. However as shown in Cobos, M., Lopez, J. J. and Marti, A. (2010). On the Effects of Room Reverberation in 3D DOA Estimation Using Tetrahedral Microphone Array. *AES* 128*th Convention*, London, UK, 2010 May 22-25 the presence of room reflections has a considerable effect on accuracy of estimated AOAs. Instead a time domain approach to AOA estimation is used relying on the accuracy of our direct path delay estimation, achieved by using analytic envelope approach paired with the probe signal. Measuring the loudspeaker/room responses with tetrahedral microphone array allows us to estimate direct path delays from each loudspeaker to each microphone capsule. By comparing these delays the loudspeakers can be localized in 3D space.

Referring to FIG. 1*b* an azimuth angle θ and an elevation angle ϕ are determined from an estimated angle of arrival (AOA) of a sound wave propagating from a loudspeaker to the tetrahedral microphone array. The algorithm for estimation of the AOA is based on a property of vector dot product to characterize the angle between two vectors. In particular with specifically selected origin of a coordinate system the following dot product equation can be written as $$r_{lk}^T \cdot s = -\frac{c}{Fs}(t_k - t_l) \tag{6}$$

where $r_{lk}$ indicates vector connecting the microphone k to the microphone 1, T indicates matrix/array transpose operation, $$s = \begin{bmatrix} s_x \\ s_y \\ s_z \end{bmatrix}$$

denotes a unary vector that is aligned with the direction of arrival of plane sound wave, c indicates the speed of sound, Fs indicates the sampling frequency, $t_k$ indicates the time of arrival of a sound wave to the microphone k and $t_l$ indicates the time of arrival of a sound wave to the microphone 1.

For the particular microphone array shown FIG. 1*b* we have $$r_{kl} = r_l - r_k = \begin{bmatrix} r_{lk} - r_{kx} \\ r_{ly} - r_{ky} \\ r_{lz} - r_{kz} \end{bmatrix}, \text{ where } r_1 = [0 \quad 0 \quad 0]^T,$$

$$r_2 = \frac{d}{2}[-\sqrt{3} \quad 1 \quad 0]^T, r_3 = \frac{d}{2}[-\sqrt{3} \quad -1 \quad 0]^T \text{ and}$$

$$r_4 = \frac{d}{3}[-\sqrt{3} \quad 0 \quad \sqrt{6}]^T.$$

Collecting equations for all microphone pairs the following matrix equation is obtained, $$\begin{bmatrix} r_{12}^T \\ r_{13}^T \\ r_{14}^T \\ r_{23}^T \\ r_{24}^T \\ r_{34}^T \end{bmatrix} \cdot s = R \cdot s = -\frac{c}{Fs} \begin{bmatrix} t_2 - t_1 \\ t_3 - t_1 \\ t_4 - t_1 \\ t_3 - t_2 \\ t_4 - t_2 \\ t_4 - t_3 \end{bmatrix} \tag{7}$$

This matrix equation represents an over-determined system of linear equations that can be solved by method of least squares resulting in the following expression for direction of arrival vector s $$\hat{s} = -\frac{c}{Fs}(R^T R)^{-1} R^T \begin{bmatrix} t_2 - t_1 \\ t_3 - t_1 \\ t_4 - t_1 \\ t_3 - t_2 \\ t_4 - t_2 \\ t_4 - t_3 \end{bmatrix} \tag{8}$$

The azimuth and elevation angles are obtained from the estimated coordinates of normalized vector $$\bar{s} = \frac{\hat{s}}{\|\hat{s}\|}$$

as $\theta = \arctan(\bar{s}_y, \bar{s}_x)$ and $\phi = \arcsin(\bar{s}_z)$ where arctan( ) is a four quadrant inverse tangent function and arcsin( ) is an inverse sine function.

The achievable angular accuracy of AOA algorithms using the time delay estimates ultimately is limited by the accuracy of delay estimates and the separation between the microphone capsules. Smaller separation between the capsules implies smaller achievable accuracy. The separation between the microphone capsules is limited from the top by requirements of velocity estimation as well as aesthetics of the end product. Consequently the desired angular accuracy is achieved by adjusting the delay estimation accuracy. If the required delay estimation accuracy becomes a fraction of sampling interval, the analytic envelope of the room responses are interpolated around their corresponding peaks. New peak locations, with fraction of sample accuracy, represent new delay estimates used by the AOA algorithm.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A method for characterizing a multi-channel loudspeaker configuration, comprising:

producing a first probe signal and a second pre-emphasized probe signal from a same frequency domain signal, producing the first probe signal further comprising:

generating the same frequency domain signal from a random number sequence;

computing an inverse Fast Fourier Transform for the random number sequence to generate the first probe signal in the time domain;

supplying the first probe signal to a plurality of audio outputs coupled to respective electro-acoustic transducers positioned in a multi-channel configuration in a listening environment for converting the first probe signal to a first acoustic response and for sequentially transmitting the acoustic responses in non-overlapping time slots separated by silent periods as sound waves into the listening environment; and for each said audio output, receiving sound waves at a multi-microphone array comprising at least two non-coincident acousto-electric transducers, each converting the acoustic responses to first electric response signals;

deconvolving the first electric response signals with the first probe signal to determine a first room response for said electro-acoustic transducer at each said acousto-electric transducer;

computing and recording in memory a delay for said electro-acoustic transducer at each said acousto-electric transducer; and recording the first room responses in memory for a specified period offset by the delay for said electro-acoustic transducer at each said acousto-electric transducer;

based on the delays to each said acousto-electro transducer, determining a distance and at least a first angle to each said electro-acousto transducer; and using the distances and at least said first angles to the electro-acousto transducers, automatically selecting a particular multi-channel configuration and computing a position for each electro-acousto transducer in that multi-channel configuration within the listening environment.

2. The method of claim 1, wherein the step of computing the delay comprises:

processing each said first electric response signal and the first probe signal to generate a time sequence;

detecting an existence or absence of a pronounced peak in the time sequence as indicating whether the audio output is coupled to the electro-acoustic transducer; and computing the position of the peak as the delay.

3. The method of claim 1, wherein the first electric response signal is partitioned into blocks and deconvolved with a partition of the first probe signal as the first electrical response is received at the acousto-electric transducers, and wherein the delay and first room response are computed and recorded to memory in the silent period prior to the transmission of the next probe signal.

4. The method of claim 3, wherein the step of deconvolving the partitioned first response signal with the partition of the first probe signal comprises:

pre-computing and storing a set of K partitioned N-point Fast Fourier Transforms (FFTs) of a time-reversed first probe signal of length K*N/2 for non-negative frequencies as a probe matrix;

computing an N-point FFT of successive overlapping blocks of N/2 samples of the first electrical response signal and storing the N/2+1 FFT coefficients for non-negative frequencies as a partition;

accumulating K FFT partitions as a response matrix;

performing a fast convolution of the response matrix with the probe matrix to provide an N/2+1 point frequency response for the current block;

computing an N-point inverse FFT of the frequency response with conjugate symmetric extension to the negative frequencies to form a first candidate room response for the current block; and appending the first candidate room responses for successive blocks to form the first room response.

5. The method of claim 4, wherein the step of estimating the delay comprises:

computing an N-point inverse FFT of the frequency response with the negative frequency values set to zero to produce a Hilbert Envelope (HE);

tracking the maximum of the HE over successive blocks to update the computation of the delay.

6. The method of claim 5, further comprising:

producing the pre-emphasized second probe signal by applying a pre-emphasis function to the same frequency domain signal;

supplying the second pre-emphasized probe signal to each of the plurality of audio outputs after the first probe signal to record second electrical response signals;

deconvolving overlapping blocks of the second response signals with the partition of the first probe signal to generate a sequence of second candidate room responses; and using the delay for the first probe signal to append successive second candidate room responses to form the second room response.

7. The method of claim 1, wherein, if said multi-microphone array comprises only two acousto-electric transducers, computing at least said first angle to electro-acoustic transducers located on a half-plane;

if said multi-microphone array comprises only three acousto-electric transducers, computing at least said first angle to electro-acoustic transducers located on a plane; and if said multi-microphone array comprises four or more acousto-electric transducers, computing at least said first angle as an azimuth angle and an elevation angle to electro-acoustic transducers located in three-dimensions.

8. A device for processing multi-channel audio, comprising:

a plurality of audio outputs for driving respective electro-acoustic transducers coupled thereto, said electro-acoustic transducers positioned in a multi-channel configuration in a listening environment;

one or more audio inputs for receiving first electric response signals from a plurality of acousto-electro transducers coupled thereto;

an input receiver coupled to the one or more audio inputs for receiving the plurality of first electric response signals;

device memory, and one or more processors adapted to implement, a probe generating and transmission scheduling module adapted to, produce a first probe signal and a second pre-emphasized probe signal from a same frequency domain signal, and supply the first probe signal to each of the plurality of audio outputs in non-overlapping time slots separated by silent periods;

a room analysis module adapted to, for each said audio output, deconvolve the first electric response signals with the first probe signal to determine a first room response at each said acousto-electric transducer, compute and record in the device memory a delay at each said acousto-electric transducer and record the first room responses in the device memory for a specified period offset by the delay at each said acousto-electric transducer, based on the delays at each said acousto-electro transducer for each said electro-acoustic transducer, determine a distance and at least a first angle to the electro-acousto transducer, and using distances and at least the first angles to the electro-acousto transducers, automatically select a particular multi-channel configuration and compute a position for each electro-acousto transducer in that multi-channel configuration within the listening environment.

9. The device of claim 8, wherein the room analysis module is adapted to partition the first electric response signal into overlapping blocks and deconvolve each block with a partition of the first probe signal as the first electrical response is received and to compute and record the delay and first room response in the silent period prior to the transmission of the next probe signal.

* * * * *